US010042285B2

(12) United States Patent
Kato et al.

(10) Patent No.: US 10,042,285 B2
(45) Date of Patent: Aug. 7, 2018

(54) DEVELOPING SYSTEM AND IMAGE FORMING APPARATUS

(71) Applicant: FUJI XEROX CO., LTD., Tokyo (JP)

(72) Inventors: Nao Kato, Kanagawa (JP); Masayuki Shimoda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/427,543

(22) Filed: Feb. 8, 2017

(65) Prior Publication Data

US 2018/0024463 A1 Jan. 25, 2018

(30) Foreign Application Priority Data

Jul. 25, 2016 (JP) ..... 2016-145249

(51) Int. Cl.
*G03G 15/08* (2006.01)
*G03G 15/09* (2006.01)

(52) U.S. Cl.
CPC ..... *G03G 15/0865* (2013.01); *G03G 15/0921* (2013.01)

(58) Field of Classification Search
CPC ..... G03G 15/0865; G03G 15/0921
See application file for complete search history.

(56) References Cited

U.S. PATENT DOCUMENTS 3,882,823 A * 5/1975 Tanaka ..... G03G 15/09 118/104
3,910,459 A * 10/1975 Bock ..... G01N 27/60 118/689
4,518,248 A * 5/1985 Nishikawa ..... G03G 21/10 399/252
4,615,606 A * 10/1986 Nishikawa ..... G03G 15/0907 222/DIG. 1
7,187,876 B2 * 3/2007 Ito ..... G03G 15/0862 399/258
7,805,098 B2 * 9/2010 Kimura ..... G03G 15/087 399/119
2007/0223970 A1 * 9/2007 Kawai ..... G03G 21/1814 399/258
2008/0219699 A1 * 9/2008 Kimura ..... G03G 15/0886 399/258

FOREIGN PATENT DOCUMENTS

JP 2005-257998 A 9/2005
JP 2015-11228 A 1/2015
JP 2015-11288 A 1/2015

* cited by examiner

*Primary Examiner* — Francis Gray
(74) *Attorney, Agent, or Firm* — Sughrue Mion, PLLC

(57) ABSTRACT

Provided is a developing system including a developing device that includes a replenishing unit that replenishes toner into an accommodating portion of a developer including toner and a carrier, via a replenishing port, a receiving unit that includes a transport member that transports received toner to a discharge port, a connecting member that has an internal space that is formed with an inlet connected with the discharge port and an outlet connected with the replenishing port, and a rotating member that is rotated in the internal space, and includes a blocking surface portion that closes the inlet and the outlet while passing over the inlet and the outlet, and a transport surface portion that receives or discharges the toner while passing over the inlet and the outlet.

8 Claims, 17 Drawing Sheets

77
74
71
72a
80(85)
17
73
75(76)
80(82)
72(S)
J
75
78

FIG. 15A
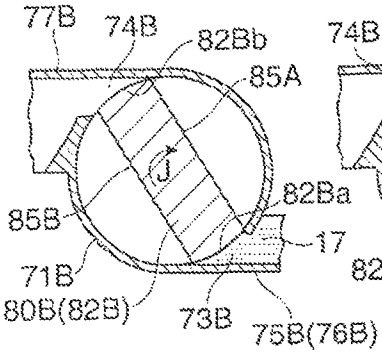
FIG. 15B
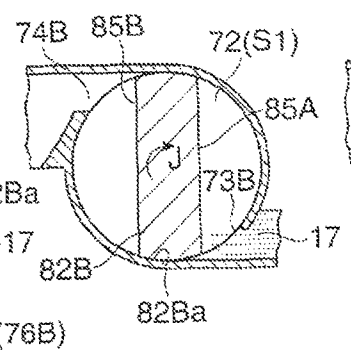
FIG. 15C
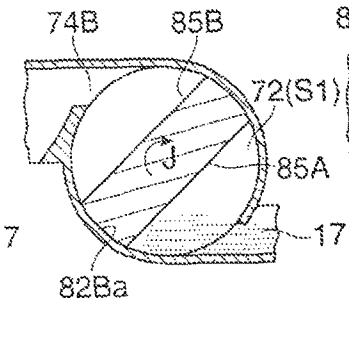
FIG. 15D
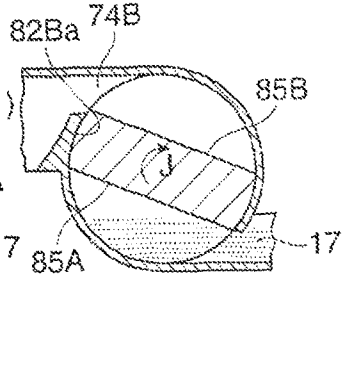
FIG. 15E
FIG. 15F
FIG. 15G
FIG. 15H

DEVELOPING SYSTEM AND IMAGE FORMING APPARATUS

CROSS-REFERENCE TO RELATED APPLICATIONS

This application is based on and claims priority under 35 USC 119 from Japanese Patent Application No. 2016-145249 filed Jul. 25, 2016.

BACKGROUND

Technical Field

The present invention relates to a developing system and an image forming apparatus.

SUMMARY

According to an aspect of the invention, there is provided a developing system including:

a developing device that includes a replenishing unit that replenishes toner into an accommodating portion of a developer including toner and a carrier, via a replenishing port;

a receiving unit that includes a transport member that transports received toner to a discharge port;

a connecting member that has an internal space that is formed with an inlet connected with the discharge port and an outlet connected with the replenishing port; and a rotating member that is rotated in the internal space, and includes a blocking surface portion that closes the inlet and the outlet while passing over the inlet and the outlet, and a transport surface portion that receives or discharges the toner while passing over the inlet and the outlet.

BRIEF DESCRIPTION OF THE DRAWINGS

Exemplary embodiments of the present invention will be described in detail based on the following figures, wherein:

FIG. 1 is an explanatory view conceptually illustrating an entire image forming apparatus according to a first exemplary embodiment and the like;

FIGS. 15A to 15H are schematic cross-sectional explanatory views illustrating sequentially in time states in which the connecting member and the rotating member of the developing system in FIG. 13 are operated;

DETAILED DESCRIPTION

Hereinafter, exemplary embodiments for carrying out the present invention (hereinafter, referred to as "exemplary embodiment") will be described with reference to the drawings.

First Exemplary Embodiment

Figure 1:
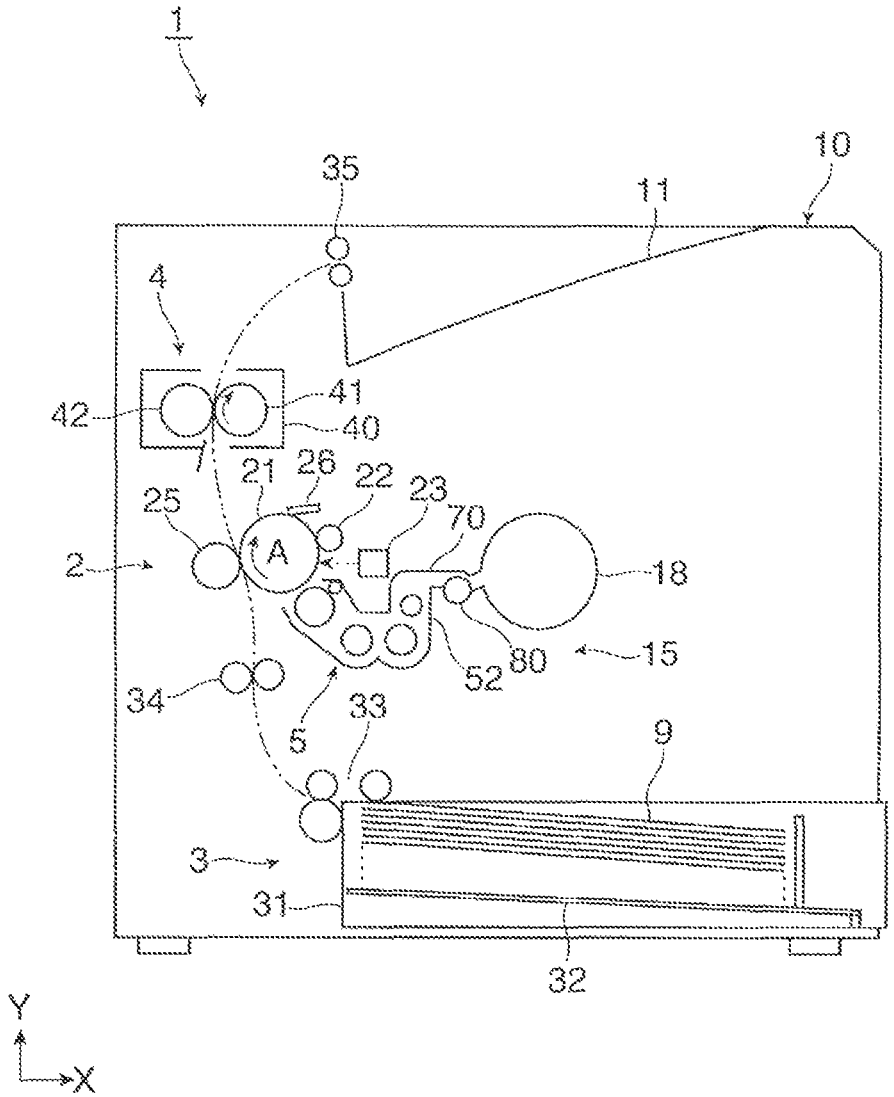
Figure 2:
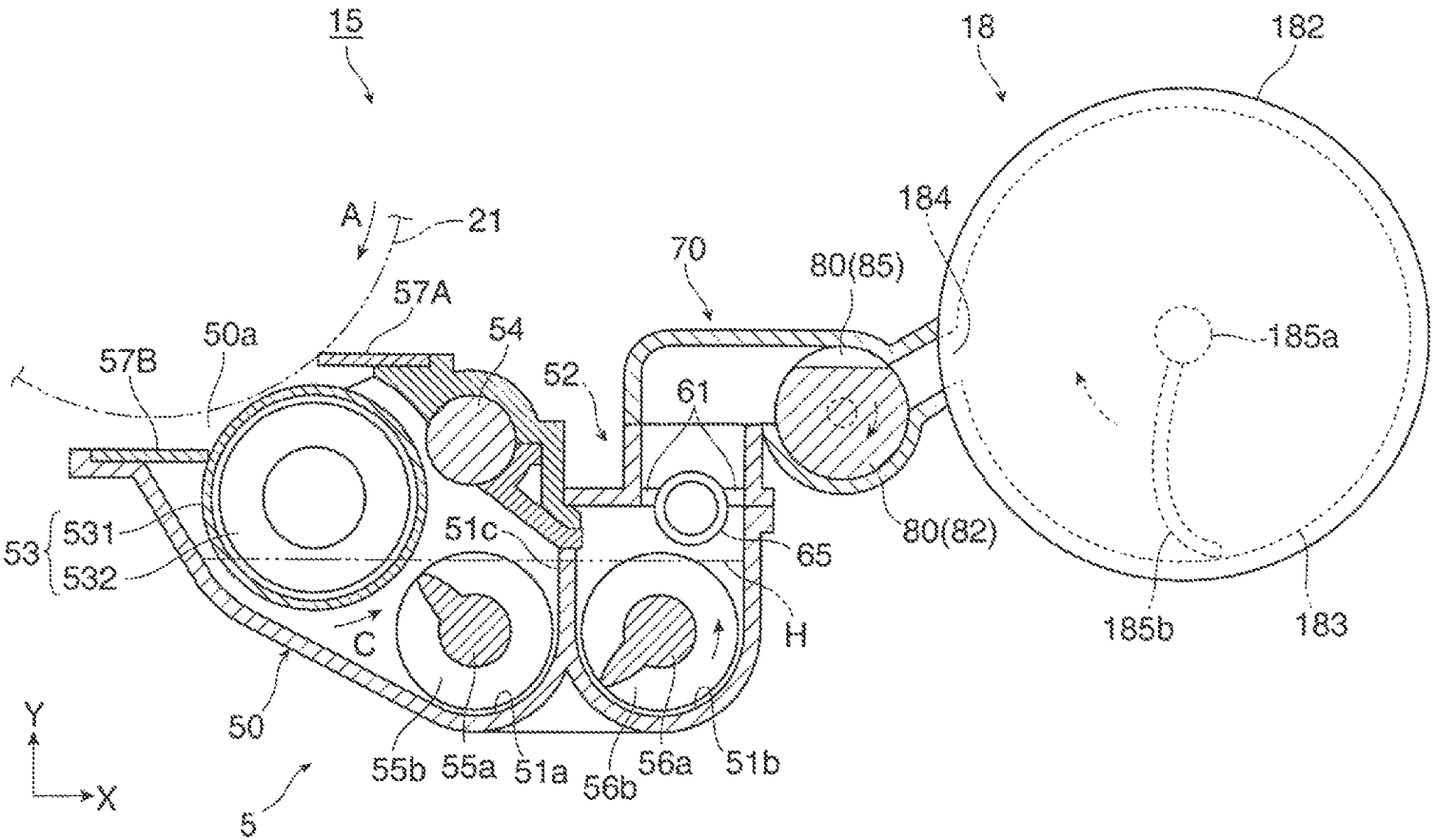
FIG. 2 is a partial cross-sectional explanatory view conceptually illustrating a developing system according to the first exemplary embodiment which is used for the image forming apparatus in FIG. 1.
Figure 3:
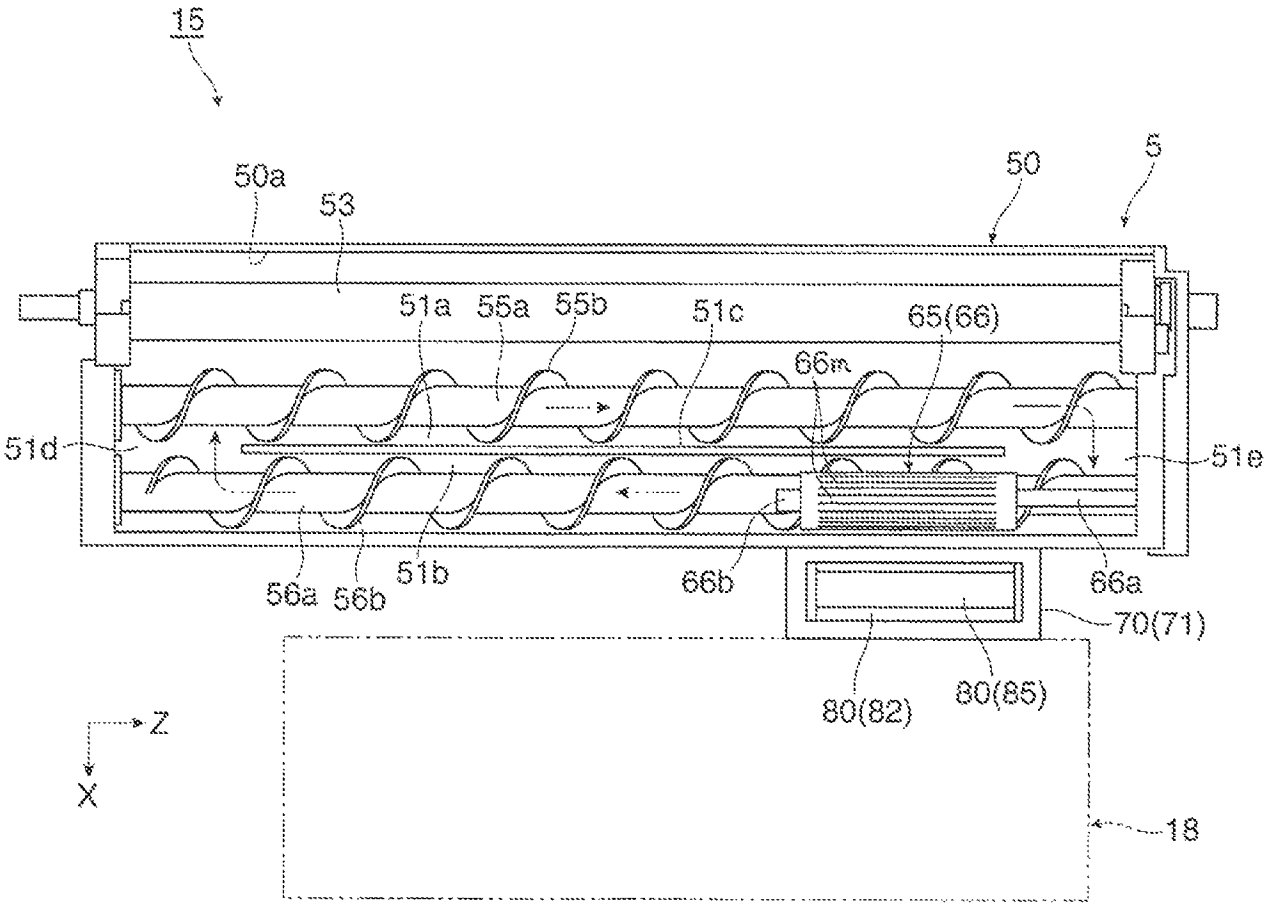
FIG. 3 is a top plan explanatory view conceptually illustrating a part of the developing system in FIG. 2.

FIGS. 1 to 3 illustrate an image forming apparatus according to a first exemplary embodiment. FIG. 1 illustrates a configuration of the image forming apparatus, FIG. 2 illustrates a configuration of a developing system provided in the image forming apparatus, and FIG. 3 illustrates a part of a configuration of the developing system. The arrows, which are illustrated in, for example, FIG. 1 and designated by symbols X, Y, and Z, indicate orthogonal coordinate axes (directions) that indicate respective directions of a width, a height, and a depth of a three-dimensional space assumed in each of the drawings.

<Overall Configuration of Image Forming Apparatus>

As illustrated in FIG. 1, an image forming apparatus 1 includes, within a case 10 that is an apparatus body, an image forming device 2 that forms an image formed by toner as a developer and finally transfers the image to a recording sheet 9 which is an example of a recording medium, a sheet feeding device 3 that accommodates necessary recording sheets 9 and supplies the recording sheet 9 to a transfer position of the imaging forming device 2, a fixing device 4 that fixes a toner image transferred to the recording sheet 9, and so on. Reference numeral 11 in, for example, FIG. 1 indicates an accommodating portion which is provided on an upper side of the case 10. The recording sheet 9 is discharged to be accommodated in the accommodating portion after the image forming has been completed thereon. The case 10 includes various members such as a structure member and an exterior material.

The imaging forming device 2 mainly includes: a photosensitive drum 21 that is an example of an image carrier that rotates in a direction indicated by an arrow A; a charging device 22 that charges a circumferential surface of the photosensitive drum 21 (an outer circumferential surface that becomes an image forming region) with a predetermined electric potential; an exposure device 23 that irradiates the circumferential surface after charging the photosensitive drum 21 with light (a dotted arrow) based on image information (signal) to form an electrostatic latent image; a developing device 5 that develops the electrostatic latent image on the photosensitive drum 21 by using the toner as a developer, to form a toner image; a transfer device 25 that transfers the toner image on the photosensitive drum 21 to the recording sheet 9; and a cleaning device 26 that cleans the circumferential surface of the photosensitive drum 21 by removing an unnecessary material such as the toner remaining on the circumferential surface.

In the photosensitive drum 21, for example, an optical dielectric layer made of an organic photosensitive material or the like is formed on the outer circumferential surface of a cylindrical electro-conductive substrate. As the charging device 22, a contact type charging device is applied to perform charging on the photosensitive drum 21 by supplying a charging electric current, or the like from a power source (not illustrated) to a contact member (a roller or the like driven to be rotated) which is in contact with the circumferential surface of the photosensitive drum 21.

The exposure device 23 performs an exposure based on an image signal that is obtained by performing a predetermined processing, by an image processing device (not illustrated), on image information inputted from an image information source such as a document reader, an external connection device, or a storage medium reader which is connected with or equipped in the image forming apparatus 1. For example, a device in which plural light emitting diodes are disposed in a line in a direction of a rotation axis of the photosensitive drum 21, or a scanning device which performs the exposure by scanning light from a semiconductor laser in an axis direction of the photosensitive drum 21 through various optical components such as a rotating polygon mirror may be used as the exposure device 23. The developing device 5 includes a developing system 15 including a toner receiving unit to be described below or the like. The details of the developing system 15 will be described below.

As the transfer device 25, a contact type transfer device is applied to perform the transfer by supplying transfer electric current or the like from a power source (not illustrated) to a pressing member (a roller driven to be rotated, a brush, or the like) that, during the transfer process, is in contact with the surface of the photosensitive drum 21 and presses the recording sheet 9 against the circumferential surface of the photosensitive drum 21 so as to allow the recording sheet 9 to pass therethrough. As the cleaning device 26, a device that brings a plate-shaped cleaning member into contact with the circumferential surface of the photosensitive drum 21 is applied.

The sheet feeding device 3 includes: a sheet accommodating body 31 that accommodates plural recording sheets 9 of a predetermined size, type, and the like for use in forming an image in a state where the plural recording sheets 9 are stacked on a loading plate 32; and sending device 33 that sends the recording sheets 9 accommodated in the sheet accommodating body 31 one by one. The sheet accommodating body 31 is mounted in such a manner that the sheet accommodating body 31 may be placed in a drawn state with respect to the case 10, and plural sheet accommodating bodies 31 are equipped according to the use states thereof. The two-dot chain lines in, for example, FIG. 1 indicate a main sheet transport path of the recording sheets 9 in the case 10.

Within a case 40 that is formed with an introduction port and a discharge port, the fixing device 4 includes: a roller type or belt type heating rotating body 41 rotated in a direction indicated by an arrow, and heated by a heating unit (not illustrated) such that a surface temperature of the heating rotating body 41 is heated to and maintained at a predetermined temperature; and a pressing rotating body 42 of a roller type, a belt-pad type, or the like, which is driven to be rotated in a state of being in contact with the heating rotating body 41 with a predetermined pressure substantial along the axial direction of the heating rotating body 41. In the fixing device 4, a contact portion where the heating rotating body 41 and the pressing rotating body 42 are in contact with each other is configured as a fixing processing portion that performs a predetermined fixing processing (heating and pressing) by allowing the recording sheet 9 having a transferred and unfixed toner image thereon to pass therethrough.

In the image forming apparatus 1, a sheet feeding transport path that includes a transport roller pair 34, a transport guide member, and the like is formed between the sending device 33 of the sheet feeding device 3, and the transfer position of the imaging forming device 2 (a portion that faces the transfer device 25 of the photosensitive drum 21). In addition, an intermediate transport path including a transport guide member and the like is formed between the transfer position of the imaging forming device 2 and a transfer processing unit of the fixing device 4. In addition, an election transport path including a transport roller pair 35, a transport guide member, and the like is formed between the transfer processing unit of the fixing device 4 and the accommodating portion 11 of the case 10.

The transport roller pair 34 in the sheet feeding transport path is a so-called registration roller pair that collides with a leading edge of the recording sheet 9 sent from the sheet feeding device 3 in a rotation-stopped state, thereby correcting an inclined posture when the entire recording sheet 9 is transported, and then starts to rotate in accordance with the transfer timing, thereby sending the recording sheet 9 such that the recording sheet 9 is introduced into the transfer position. The transport roller pair 35 in the election transport path refers to discharge rollers that send the fixed recording sheet 9 to the accommodating portion 11.

An image formation by the image forming apparatus 1 is performed as follows. Here, a basic image forming operation performed when forming an image on a single surface of a recording sheet 9 will be described by way of an example.

In the image forming apparatus 1, when a controller (not illustrated) receives an initiation command pertaining to the image forming operation, the circumferential surface of the photosensitive drum 21 of the imaging forming device 2, which starts to rotate, is charged with predetermined polarity and an electric potential by the charging device 22, and then the exposure based on the image information is performed on the charged circumferential surface of the photosensitive drum 21 by the exposure device 23 such that an electrostatic latent image having a predetermined pattern is formed. Subsequently, the electrostatic latent image formed on the photosensitive drum 21 is developed by a toner charged with a predetermined polarity (in this example, negative polarity) and supplied when the latent image passes through the developing device 5 such that the latent image is visualized as a toner image.

Thereafter, the toner image formed on the photosensitive drum 21 is transported, by the rotation of the photosensitive drum 21, to the transfer position that faces the transfer device 25. In addition, in accordance with the timing, the recording sheet 9 is supplied to the transfer position of the imaging forming device 2 from the sheet feeding device 3 through the sheet feeding transport path. Therefore, the toner image on the photosensitive drum 21 at the transfer position is transferred mainly in an electrostatic manner to the single surface of the recording sheet 9 by being subjected to a transfer action of the transfer device 25. After the transfer, the circumferential surface of the photo sensitive drum 21 is cleaned by the cleaning device 26.

Subsequently, the recording sheet 9 having the toner image transferred thereon is peeled from the photosensitive drum 21 at the transfer position, and then transported to the fixing device 4 via the intermediate transport path. Subsequently, the recording sheet 9 is subjected to the fixing processing when the recording sheet 9 is introduced into and passes through the fixing processing portion between the heating rotating body 41 and the ping rotating body 42 of the fixing device 4, and therefore, the toner of the toner image on the single surface of the recording sheet 9 is fixed by being melted under pressure. After the fixing is terminated, the recording sheet 9 is discharged from the fixing device 4 and transported via the ejection transport path.

Finally, the recording sheet 9 is discharged from the discharge port of the case 10, and accommodated in the accommodating portion 11.

Consequently, a monochrome image made of single color toner is formed on the single surface of one recording sheet 9, and the basic image forming operation ends. In a case in which a command to execute an image forming operation on plural recording sheets is issued, the aforementioned series of operations are repeatedly performed in accordance with the number of recording sheets.

<Configuration of Developing System>

Next, the developing system 15 wild be described.

As illustrated in, for example, FIGS. 1 to 3, the developing system 15 includes: a developing device 5 including an accommodating portion 51 that accommodates a developer including a toner 17 and a magnetic carrier, and a replenishing unit 52 that replenishes the toner 17 to the accommodating portion 51; a toner receiving unit 18 that receives the toner replenished to the accommodating portion 51 of the developing device 5; a connecting member 70 provided between the replenishing unit 52 of the developing device 5 and the toner receiving unit 18; and a rotating member 80 disposed to be rotated within an internal space of a part of the connecting member 70.

(Configuration of Developing Device)

As illustrated in, for example, FIGS. 2 and 3, the developing device 5, which configures the developing system 15, includes a case 50 in which the respective configuring members are disposed and accommodated. The configuring members such as a developing roller 53, a layer thickness regulating member 54, and two agitation transport members 55 and 56 are mainly disposed within the case 50.

As illustrated in, for example, FIGS. 2, 3, and 6, the case 50 is a structure that has an external appearance shape entirely elongated in one direction, and includes the accommodating portion 51 in which the developer is accommodated, a developing opening 50*a* that opens a portion of the accommodating portion 51 facing the photosensitive drum 21, and the toner replenishing unit 52 that receives the developer (in fact, the toner 17) replenished to the accommodating portion 51 according to a decreasing state (consumption state) of the toner in the accommodating portion 51 which is consumed due to the developing operation.

For example, the case 50 is divided into a main body portion (case lower portion) which configures a structure at a lower side of the case 50, and a cover portion (case upper portion) which closes an upper side of the main body portion, and configures a structure at an upper side of the case 50. In addition, a developer, which includes the toner 17 including colored (black and the like) fine powder and magnetic carrier including particles having magnetism, that is, a so-called two-component developer is used as the developer.

The accommodating portion 51 is formed in a shape having two rows of transport paths 51*a* and 51*b* (a first transport path 51*a* and a second transport path 51*b*) which are in parallel with the axial direction of the developing roller 53.

The two rows of the transport paths 51*a* and 51*b* are partitioned by a partition wall 51*c* at a central portion where they are adjacent to each other, and the two rows of the transport paths 51*a* and 51*b* are connected by connecting end portions 51*d* and 51*e* which are connected to each other without the partition wall 51*c* at the upstream end portion and the downstream end portion thereof in a transport direction, thereby defining a circulation type passageway therearound. In addition, in the two rows of the transport paths 51*a* and 51*b*, the first transport path 51*a*, which is close to the developing roller 53, is mainly used as a supplying transport path for practically supplying the developer to the developing roller 53, and the second transport path 51*b*, which is distant from the developing roller 53, is mainly used as an agitating transport path for agitating the developer.

The developing opening 50*a* is formed in a rectangular shape having a slightly greater dimension than an image forming effective region in the direction of the rotation axis of the photosensitive drum 21. Reference numerals 57A and 57B in FIG. 2 indicate seal members that prevents the developer (mainly, the toner 17) from leaking from a gap between the developing device 5 and the photosensitive drum 21, or a gap between the developing opening 50*a* of the case 50 and the developing roller 53.

The developing roller 53 forms a magnetic brush (nap) by holding the developer in the accommodating portion 51 on a circumferential surface of the developing roller 53, and transports the developer, which is held as the magnetic brush, to a position that faces the outer circumferential surface of the photosensitive drum 21 with a predetermined gap being interposed therebetween. As illustrated in, for example, FIG. 2, the developing roller 53 includes: a cylindrical sleeve 531 which is provided to be rotated in the case 50 in a state where the cylindrical sleeve 531 is partially exposed from the developing opening 50*a*, and a magnet roller 532 which is a magnet member provided in a state of being fixed in a cylindrical space of the sleeve 531.

The sleeve 531 is a cylindrical member made of a non-magnetic material such as stainless steel or aluminum, and both end portions of the sleeve 531 are rotatably mounted on a shaft portion of the magnet roller 532. In addition, a gear (not illustrated) is mounted on one end portion of the sleeve 531, and the sleeve 531 is rotated in a direction indicated by an arrow C by receiving a rotational power that is transmitted to the gear from a rotation driving device (not illustrated). In addition, a developing electric current or the like is supplied between the sleeve 531 and the photosensitive drum 21 from a power source (not illustrated).

The magnet roller 532 has a structure in which plural magnetic poles (S-poles and N-poles) are disposed on an outer circumferential surface of the sleeve 531 to generate a magnetic force for attaching the magnetic carrier of the developer so as to form a magnetic brush linked in the form of a chain along a magnetic force line. For example, the magnet roller 532 is mounted in a state where the shaft portions formed to protrude from both end portions of the magnetic roller 532, respectively, are fixed to the side wall portions of the case 50.

The layer thickness regulating member 54 regulates a layer thickness of the developer (magnetic brush) held on the sleeve 531 of the developing roller 53 such that the layer thickness is almost uniformly maintained.

The layer thickness regulating member 54 is fixedly mounted on the side wall portions of the case 50 to be maintained in a state where the layer thickness regulating member 54 faces the sleeve 531 along the axial direction of the sleeve 531 at a predetermined gap (regulating interval), which corresponds to a necessary layer thickness of the developer, with the outer circumferential surface of the sleeve 531 of the developing roller 53. As the layer thickness regulating member 54, for example, a cylindrical member is applied which has a length equal to or larger than a length of an effective developing region in the direction of the rotation axis (of the sleeve 531) of the developing roller 53. In addition, a member made of a non-magnetic material such as, for example, stainless steel, is applied as the layer thickness regulating member 54.

As illustrated in, for example, FIGS. 2 and 3, the two agitation transport members 55 and 56 are separately disposed in the first transport path 51*a* and the second transport path 51*b* of the case 50, and transport the developer accommodated in the transport paths 51*a* and 51*b* in a predetermined direction indicated by arrows of two-dot chain lines while agitating the developer.

A structure in which a transport blade 55*b* or 56*b* is spirally wound around the circumferential surface of a rotating shafts 55*a* or 56*a*, that is, a so-called screw auger, is applied to either of the agitation transport member 55 or 56. In addition, in the agitation transport members 55 and 56, both end portions of each of the rotating shafts 55*a* and 56*a* are mounted to be rotatable with respect to bearings (not illustrated) provided on the sidewall surfaces of the case 50, and a gear (not illustrated) is mounted on one end portion of each of the rotating shafts 55*a* and 36*a* such that a rotational power distributed from (the sleeve 531 of) the developing roller 53 is transmitted so as to rotate each of the agitation transport members 55 and 56 in a predetermined direction.

In the accommodating portion 51, the developer accommodated in the second transport path 51*b* is transported from one end portion to the other end portion in a direction indicated by the arrows of two-dot chain lines while being agitated by the agitation transport member 56, and then sent to the first transport path 51*a* through the connecting end portion 51*d*. In addition, in the accommodating portion 51, the developer accommodated in the first transport path 51*a* is transported from one end portion to the other end portion in the direction indicated by the arrows of two-dot chain lines while being agitated by the agitation transport member 56, and at the same time, a part of the developer is transported while being supplied to the developing roller 53 side, and then sent to the second transport path 51*b* through the connecting end portion 51*e*. As described above, the developer is transported while entirely circulating in the accommodating portion 51 by sequentially and repeatedly passing through the first transport path 51*a* and the second transport path 51*b*.

(Basic Operation of Developing Device)

At an operation timing, for example, during an image forming operation by the image forming apparatus 1, the developing device 5 operates as follows.

First, at the operation timing of the developing device 5, the sleeve 531 of the developing roller 53 and the agitation transport members 55 and 56 begin to rotate in the developing device 5, and at the same time, a developing voltage is supplied to the sleeve 531 of the developing roller 53.

Therefore, the two-component developer accommodated in the accommodating portion 51 of the case 50 is transported in the direction indicated by the arrows of two-dot chain lines in FIG. 3 in the first transport path 51*a* and the second transport path 51*b* in the accommodating portion 51 while being agitated by the rotating agitation transport members 55 and 56. When viewed as a whole, the developer is transported in a state of circulating in the accommodating portion 51. At this time, in the developer, the toner 17 is triboelectrically charged by being sufficiently agitated with the magnetic carrier, and at the same time, the toner 17 electrostatically adheres to the surface of the carrier.

Subsequently, in the developing device 5, a part of the developer, which is transported by the agitation transport member 55 disposed at a position close to the developing roller 53, is held by being adsorbed to the outer circumferential surface of the sleeve 531 of the developing roll 53 by a magnetic force.

At this time, the developer is held in a state of forming a magnetic brush on the outer circumferential surface of the rotating sleeve 531. In addition, the held developer passes through a predetermined gap (regulating gap) formed between the sleeve 531 and the layer thickness regulating member 54 in the middle of being transported by the rotation of the sleeve 531 in the direction indicated by the arrow C. At this time, the passage of a part of the developer is regulated such that the fixed layer thickness (the height of the magnetic brush) is substantially fixed.

Subsequently, in the developing device 5, the developer, which has passed through the layer thickness regulating member 54, passes through the developing opening 50*a* by the rotation of the sleeve 531 in the direction indicated by the arrow C.

Thereafter, the developer is transported to a developing region that faces the photosensitive drum 21.

The developer, which has been transported to the developing region, is caused to pass through the magnetic brush in a state where the tip portion of the magnetic brush is in contact with the outer circumferential surface of the photosensitive drum 21. At the time of passing through the magnetic brush, only the toner 17 reciprocally moves between the developing roller 53 and the photosensitive drum 21 and electrostatically adheres to a portion of the electrostatic latent image on the photosensitive drum 21 by a developing (alternating) electric field formed between the developing roller 53 and the photosensitive drum 21 by a developing electric current including an alternating current supplied to the sleeve 531. Therefore, the electrostatic latent image is developed by the developing device 5.

In the developing device 5, the developer on the developing roller 53, which has passed through the developing region without contributing to the developing process, is transported into the case 50 through the developing opening 50*a* in a state of being held on the outer circumferential surface of the sleeve 531 by a magnetic force, and then, in principle, the developer is peeled off from the sleeve 531 and returned back to the inside of the accommodating portion 51 (in fact, the first transport path 51*a*).

The developer, which has been peeled off and returned back, is transported while being agitated again in the first transport path 51*a* by the agitation transport member 55, and is then returned back to the first transport path 51*a* via the second transport path 51*b* such that the developer is transported in a circulated manner to be reused.

Meanwhile, as the developing operation is performed in the developing device 5, the toner 17 in the developer is consumed by being supplied from the developing roller 53 to the photosensitive drum 21. As a result, the toner 17 in the developer in the accommodating portion 51 is reduced.

(Configuration of Toner Replenishing Unit)

The toner 17 in the developer in the accommodating portion 51 is reduced by the amount of toner 17 consumed as the developing device 5 performs the developing operation as described above. Thus, the toner replenishing unit 52 of the developing device 5 is an area in which an operation of replenishing the accommodating portion 51 with new toner 17 is performed in order to supplement the reduced amount of toner 17.

In the toner replenishing unit 52, an operation is performed to cause the accommodating portion 51 to be replenished with new toner 17 through a replenishing port 61 which is opened and closed in accordance with a state in which the toner 17 in the accommodating portion 51 is consumed. The opening and closing of the replenishing port 61 is performed in accordance with a state in which the toner 17 in the accommodating portion 51 is consumed, for example, by bringing the replenishing port 61 into a opened state by making the developer not present in the replenishing port 61 and by bringing the replenishing port 61 into a closed state in by making the developer present in the replenishing port 61.

Figure 4:
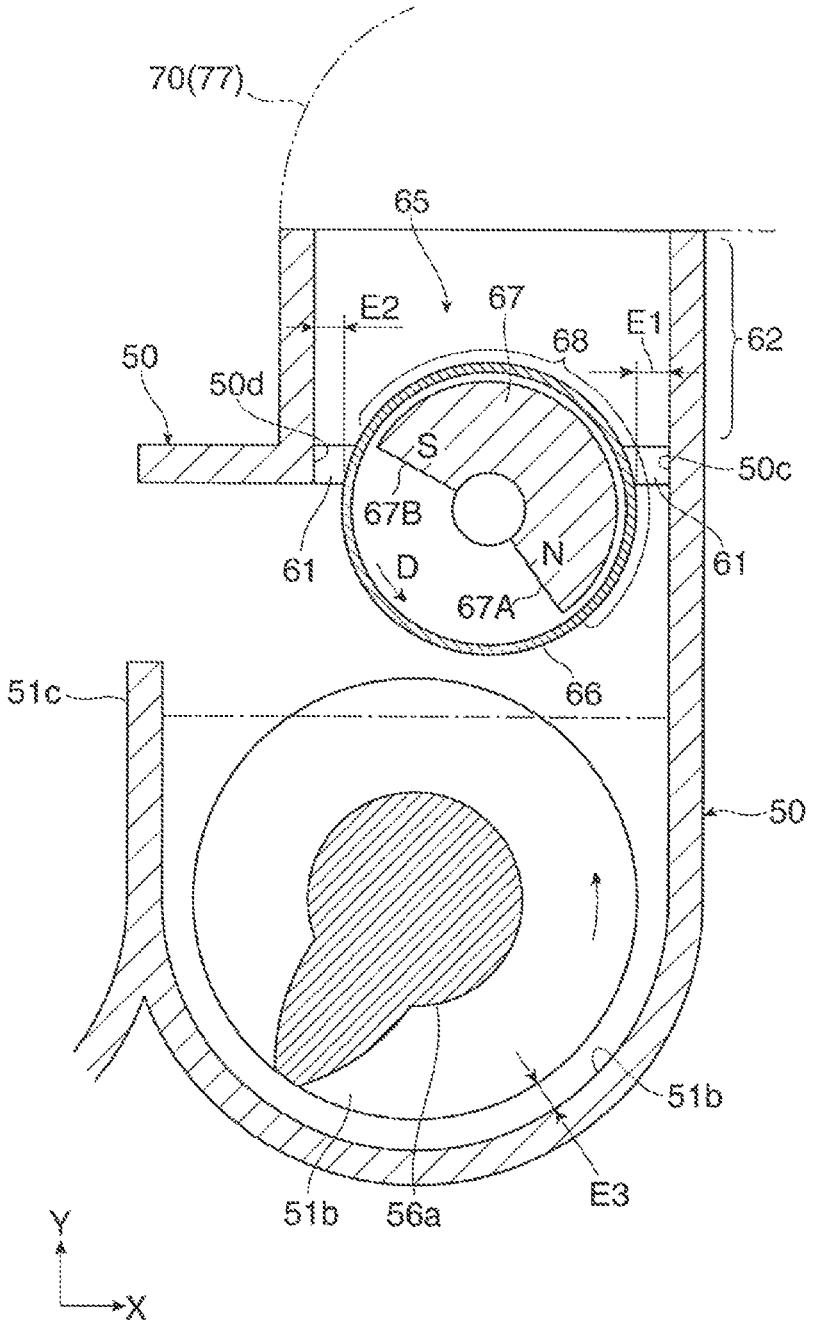
FIG. 4 is a cross-sectional explanatory view illustrating a configuration of a toner replenishing unit of a developing device of the developing system in FIG. 2 is as enlarged scale.

In the first exemplary embodiment, as illustrated in, for example, FIGS. 2 to 4, the toner replenishing unit 52 includes the replenishing port 61 provided at an upper side of the second transport path 51*b* in the accommodating portion 51 of the case 50 to receive the replenishing toner 17, and a rotating body 65 which is an example of a rotating member provided to be rotated in a state of facing the replenishing port 61 with a gap E (E1 or E2) being interposed therebetween.

The replenishing port 61 is a portion located above the second transport path 51*b*. The replenishing port 61 is formed as an opening portion having a rectangular shape in a plan view at a position biased to the upstream side of the second transport path 51*b* in the transport direction of the developer. In addition, the replenishing port 61 is formed to be present at a lower end of an angular cylindrical protruding portion 62 provided to protrude by a predetermined height from the upper side of the case 50.

The rotating body 65 includes a rotating cylindrical member 66 having a cylindrical shape, and a magnet member 67 fixedly disposed in an internal space of the cylindrical member 66.

The cylindrical member 66 is a cylindrical member of which the outer diameter has a dimension greater than the length of a short side of a rectangle of a plane shape of the replenishing port 61, and the length in a direction of a rotation axis has a dimension greater than the length of a long side of the rectangle of a plane shape of the replenishing port 61. The cylindrical member 66 is in the state in which the upper portion of the outer circumferential surface of the cylindrical member 66 is located adjacent to the long side of the replenishing port 61 with a predetermined gap being interposed therebetween. Further, the cylindrical member 66 is rotatably mounted on mounting support portions (not illustrated) of the case 50 through shaft portions 66*a* and 66*b* provided at the opposite end portions thereof in the direction of the rotation axis. In addition, the cylindrical member 66 is rotated in predetermined direction D as a gear (non-illustrated) is mounted an end portion of one shaft portion 66*a* and a rotational power distributed from (the rotating shaft 56*a* of) the agitation transport member 56 is transmitted to the gear.

When viewed downward from the upper side of the developing device 5, the cylindrical member 66 is disposed such that a first gap E1 is formed between the replenishing port 61 (the rear wall surface 50*c* of the case which configures the replenishing port 61) and the upstream side of the outer circumferential surface of the cylindrical member 66 in the rotation direction D, and a second gap E2 is formed between the replenishing port 61 (the front wall surface 50*d* of the case which configures the replenishing port 61) and the downstream side of the outer circumferential surface of the cylindrical member 66 in the rotation direction D.

At this time, the first gap E1 mainly becomes a space through which the developer adsorbed and held on the outer circumferential surface of the cylindrical member 66 mainly passes, and the second gap E2 mainly becomes a space through which the replenishing toner 17 passes when the replenishing toner 17 is replenished. In addition, the second gap E2 is set to, for example, about 1 mm, and generally set to a value smaller than a dimension (e.g., 2 mm) of the first gap E1. In addition, the second gap E2 is set to a dimension almost equal to a minimum gap E3 between an inner wall surface of the second transport path 51*b* and the transport blade 56*b* of the agitation transport member 56. In addition, for example, FIGS. 2, 4, 6, and 8 exaggeratedly illustrate the replenishing port 61 (the gaps E1 and E2 thereof) as an opening having a dimension larger than an actual dimension in order to easily identify (the gaps E1 and E2 of) the replenishing port 61 for convenience (the same applies to the other exemplary embodiments).

The cylindrical member 66 is made of a non-magnetic material such as, for example, an aluminum alloy. In addition, in the first exemplary embodiment, straight minute grooves 66*m* are formed in the outer circumferential surface of the cylindrical member 66 at regular intervals in the direction of the rotation axis.

The magnet member 67 is a member that is provided with: a first magnetic pole (a pick-up pole) 67A that generates a magnetic force for attracting upward, against gravity, the developer, which is accommodated in at least the second transport path 51*b* of the accommodating portion 51 and has an upper surface (an accommodating surface or a developer surface) 16*a* existing at a position higher than a predetermined reference height H in the developing device 5, so as to cause the developer to be adsorbed to the outer circumferential surface of the cylindrical member 66; and a second magnetic pole (a holding pole) 67B that generates magnetic force for holding the developer, which is adsorbed to the first magnetic pole 67A, on the outer circumferential surface of the cylindrical member 66.

Here, the reference height H refers to a height at which the rotating body 65 starts to hold the developer in the second transport path 51*b* by magnetic force when at least the developer accommodated in the second transport path 51*b* of the accommodating portion 51 exceeds the height H. In other words, the reference height H substantially corresponds to a height when the toner concentration in the developer existing in the entire accommodating portion 51 (in the present example, the second transport path 51*b*) reaches an upper limit value in a desired toner concentration range required for the developing device 5.

The reference height H is a concept for specifying a position in a height direction relative to the rotating body 65 rather than indicating a physical length in the height direction from the bottom surface within the accommodating portion 51 (in the present example, the second transport path 51*b*). In addition, in the developing device 5, the developer is accommodated in the accommodating portion 51 in advance in the step of initially using the developing device 5 by an amount that exceeds the reference height H.

The second magnetic pole 67B is a magnetic pole (e.g., S-pole) having a polarity opposite to that of the first magnetic pole 67A (e.g., N-pole). Therefore, the magnet member 67 forms a bundle of magnetic force lines (magnetic field) directed from the first magnetic pole 67A to the second magnetic pole 67B. With the formation of the magnetic field, a developer 16*b* (see, for example, FIGS. 6A and 6B) adsorbed to the outer circumferential surface of the cylindrical member 66 is held. In addition, the second magnetic pole 67B is disposed at a position which is a downstream side with respect to the first magnetic pole 67A in the rotation direction D of the cylindrical member 66.

The position, where the first magnetic pole 67A is disposed, is set based on a distance or the like at which the developer (on the upper surface 16*a* of the developer) may be adsorbed to the outer circumferential surface of the cylindrical member 66 by the magnetic force when the developer is accommodated by an amount that satisfies the reference height H. Meanwhile, the position, where the second magnetic pole 67B is disposed, is set based on a position (a position for securing a predetermined inter-pole angle with the first magnetic pole 67A) at which may generate magnetic force lines for transporting the developer adsorbed to the outer circumferential surface of the cylindrical member 66 by a predetermined distance in the rotation direction D of the cylindrical member 66 by using the first magnetic pole 67A.

The rotating body 65 is formed with a magnetic force generating region 68 that generates magnetic force for attracting and holding the developer (in fact, the magnetic carrier) on the outer circumferential surface of the cylindrical member 66 as the first magnetic pole 67A and the second magnetic pole 67B exist in the magnet member 67 in the internal space of the cylindrical member 66.

(Configuration of Toner Receiving Unit)

As illustrated in, for example, FIG. 2, the toner receiving unit 18, which configures the developing system 15, is disposed to be present at a position deviated from the toner replenishing unit 52 of the developing device 5 in a horizontal direction (in a direction along the coordinate axis X). In the first exemplary embodiment, the toner receiving unit 18 is disposed at a position spaced apart from the toner replenishing unit 52 of the developing device 5 obliquely upward in a direction opposite to the side where the developing roller 53 is present.

As illustrated in, for example, FIGS. 2 and 3, the toner receiving unit 18 includes an accommodating container 182 having an accommodating space 183 that accommodates the toner 17 to be replenished to the accommodating portion 51 of the developing device 5, and a discharge port 184 that discharges the toner 17 in the accommodating space 183 to the outside, and a transport member 185 that transports the toner 17 in the accommodating container 182 toward the discharge port 184.

For example, a cartridge type container, which is detachably mounted on a container mounting portion (not illustrated) provided in the case 10 of the image forming apparatus 1, is applied as the accommodating container 182. In the first exemplary embodiment, the accommodating space 183 of the accommodating container 182 is formed in substantially cylindrical shape, and the discharge port 184 is formed at a portion in the vicinity of one end in a direction along a centerline of the cylinder of the accommodating space 183.

The transport member 185 applied here includes a rotating shaft 185*a* rotatably disposed in the accommodating space 183 and a transport unit 185*b* having a predetermined shape such as a sheet member or a bar shaped member that is fixed to the rotating shaft 185*a*. The transport unit 185*b* is configured in a shape that obtains at least a transport force for transporting and moving the toner 17 in the accommodating space 183 to the discharge port 184 and sending the toner 17 from the discharge port 184 when the transport portion 185*b* is rotated together with the rotating shaft 185*a*. For example, the rotation of the transport member 185 is driven in a predetermined direction exemplified by a dotted arrow line as the rotational power is transmitted from a rotation driving device (not illustrated) to a gear (not illustrated) mounted on one end portion of the rotating shaft 185*a*.

The toner receiving unit 18 is configured such that the transport member 183 rotates in conjunction with the operation timing of the developing device 5. For this reason, the toner receiving unit 18 continuously discharges the toner 17 in the accommodating container 182 from the discharge port 184 by the transport force of the transport member 185 during the operation of the developing device 5.

(Basic Operations of Toner Replenishing Unit and Toner Receiving Unit)

At the operation time of the developing device 5, the rotating body 65 of the toner replenishing unit 52 starts to rotate in conjunction with the start of the developing device 5. Further, at the operation time of the developing device 5, the transport member 185 in the toner receiving unit 18 also starts to rotate.

Therefore, the toner 17 received in the toner receiving unit 18 is discharged from the discharge port 184 by the transport force of the transport member 185, and then transported to the toner replenishing unit 52 via the connecting member 70.

At this time, the toner 17 is also continuously conveyed from the toner receiving unit 18 to the toner replenishing unit 52 via the connecting member 70. For this reason, in the toner replenishing unit 52, a certain amount of the toner 17 is reserved in a space inside the replenishing port 61 (in fact, a space surrounded by the protruding portion 62) to form a toner reservoir 17K (see, for example, FIGS. 6A and 6B).

Figure 6B:
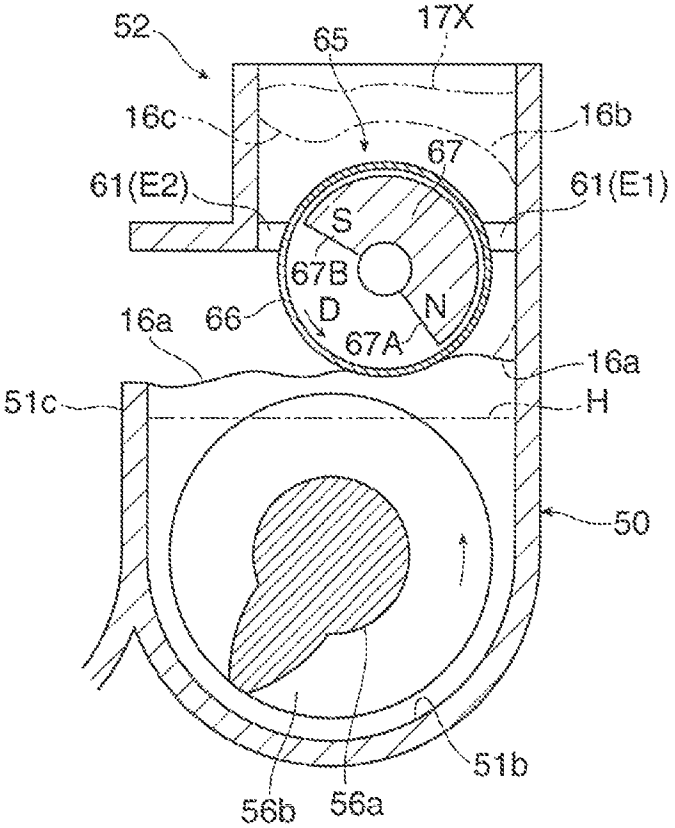
FIG. 6B is a main part cross-sectional explanatory view illustrating a state in which the toner replenishing unit in FIG. 4 is operated at a different specific timing.
Figure 6A:
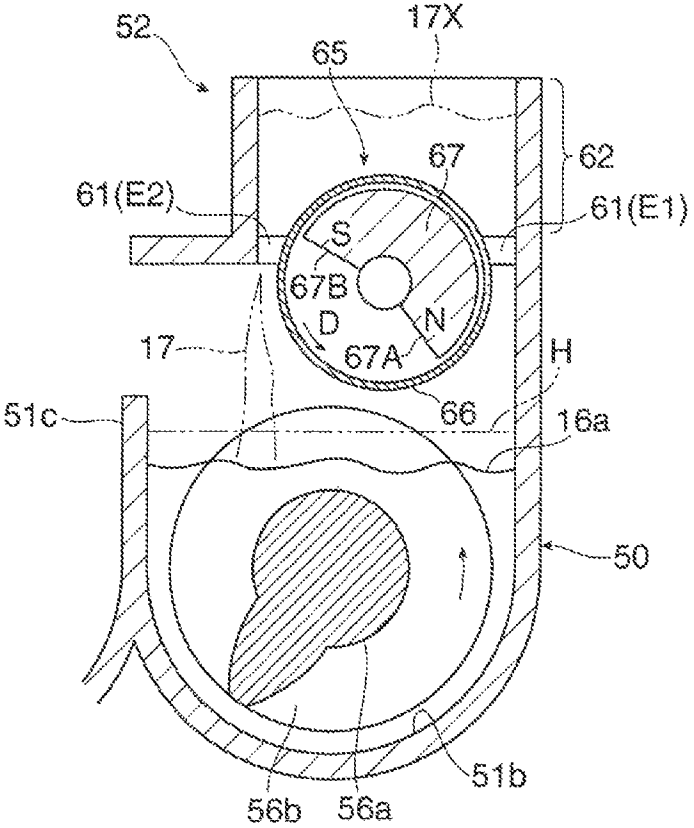
FIG. 6A is a main part cross-sectional explanatory view illustrating a state in which the toner replenishing unit in FIG. 4 is operated at a specific timing.

As exemplified in FIG. 6A, in the toner replenishing unit 52, as the toner 17 is consumed according to the developing operation of the developing device 5, the height of the upper surface 16*a* of the developer accommodated in the accommodating portion 51 may become equal to or lower than the reference height H. At this time, in the toner replenishing unit 52, the magnetic attractive force by (the first magnetic pole 67A of) the magnetic force generating region 68 of the rotating body 65 is not applied to the developer in the accommodating portion 51, or the attractive force is not able to resist the gravity and the like of the developer itself even if the attractive force is applied. As a result, the developer is neither adsorbed to the outer circumferential surface of the rotating body 65 (cylindrical member 66) nor held thereon.

In a case in which the height of the upper surface 16*a* of the developer becomes equal to or lower than the reference height H, the developer in the accommodating portion 51 is not transported to the replenishing port 61 by the rotating body 65, and the developer does not remain in the second gap E2 between the replenishing port 61 and the rotating body 65. As a result, the replenishing port 61 is not clogged by the presence of the developer so that the replenishing port 61 is in an opened state, as described below.

As a result, in the toner replenishing unit 52, the replenishing toner 17 including the toner 17 that has become the toner reservoir 17X in the replenishing port 6:1 passes through the second gap E2 of the replenishing port 61 by receiving the gravity and the rotational transport force of the rotating body 65, and is replenished to be dropped into the second transport path 51*b* of the accommodating portion 51.

In the developing device 5 having the toner replenishing unit 52, the magnetic carrier in the developer accommodated in the accommodating portion 51 is neither discharged from the accommodating portion 51, nor replenished to the accommodating portion 51 so that the amount of the magnetic carrier does not vary. For this reason, when the toner 17 is replenished from the toner replenishing unit 52 so that the overall amount of the developer in the accommodating portion 51 is increased, the toner concentration) in the developer is increased (restored). Meanwhile, when the toner 17 is consumed due to the developing operation so that the amount of toner 17 in the developer in the accommodating portion 51 is reduced, the toner concentration in the developer is reduced.

In the developer, there is a case in which a repulsive force is created between the toner 17 and the magnetic carrier so that, an apparent volume of the developer in the accommodating portion 51 becomes larger than the amount of practically accommodated developer (the increased amount of the developer). In this case, when the amount of the toner 17 is increased by replenishing the toner 17, the amount (volume) of the developer becomes higher than the increased volume of the toner 17.

On the contrary, as illustrated in FIG. 6B, in the toner replenishing unit 52, when the upper surface 16*a* of the developer accommodated in the accommodating portion 51 is raised and exceeds the reference height H due to the replenishment of the toner 17, the magnetic attractive force by (the first magnetic pole 67A of) the magnetic force generating region 68 of the rotating body 65 is applied to the developer in the accommodating portion 51, and a part of the raised developer is adsorbed to the outer circumferential surface of the rotating body 65 (the cylindrical member 66) to be held thereon.

In this case, the part 16*b* of the developer in the accommodating portion 51 is transported to the replenishing port 61 and also passes through the first gap E1 by the rotating body 65, and the developer 16*b* (remaining developer 16*c*) finally remains the second gap E2 between the replenishing port 61 and the rotating body 65. As a result, the replenishing port 61 (in fact, both the gaps E1 and E2) is clogged by the presence of the developer 16*b* held on and transported by the rotating body 65 to be in a closed state.

As a result, in the toner replenishing unit 52, because the replenishing toner 17 including the toner 17, which has become the toner reservoir 17X in the replenishing port 61 is not able to pass through the second gap E2 that has been clogged by the developer 16*b* transported by the rotating body 65, the replenishment of the toner 17 into the second transport path 51*b* of the accommodating portion 51 is stopped.

(Configuration of Connecting Member)

Figure 5A:
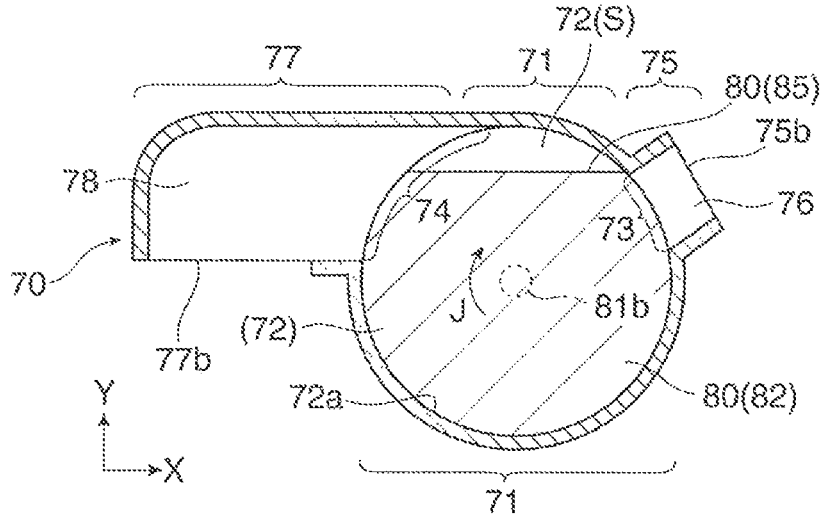
FIG. 5A is a cross-sectional explanatory view illustrating configurations of a connecting member and a rotating member of the developing system in FIG. 2.

As illustrated in, for example, FIGS. 2 and 5A, the connecting member 70, which configures the developing system 15, is a member provided between the toner replenishing unit 52 of the developing device 5 and the toner receiving unit 18, and provides a transport path for transporting the toner 17 in the toner receiving unit 18 to the toner replenishing unit 52.

The connecting member 70 is configured as a member that includes: a main body portion 71 that is formed with a cylindrical internal space 72; a first connecting portion 75 that connects the discharge port 184 of the toner receiving unit 18 and an inlet 73 formed in a part of the inner wall which has a cylindrical side surface shape and configures the internal space 72 of the main body portion 71; and a second connecting portion 77 that connects the replenishing port 61 of the toner replenishing unit 52 and an outlet 74 formed in another part of the inner wall which has a cylindrical side surface shape and configures the internal space 72 of the main body portion 71.

The main body portion 71 is a structural portion having the internal space 72 having a space shape similar to a shape formed when a cylinder falls down substantially horizontally. In the first exemplary embodiment, the entire main body portion 71 is configured in a cylindrical shape, but the shape of the external appearance is not particularly limited. In addition, in the main body portion 71, the inlet 73, which receives the toner 17, is formed in a part of the inner wall 72*a* which has a curved surface shape like a side surface of a cylinder and configures the cylindrical internal space 72, and the outlet 74, which discharges the toner 17, is formed in a separate part of the inner wall 72*a*.

Either of the inlet 73 or the outlet 74 is formed as a rectangular opening having a long side in a longitudinal direction of the cylindrical internal space 72. In addition, the inlet 73 is formed to be present in a surface on which the toner receiving unit 18 is present at a position higher than the central axis of the cylindrical shape of the internal space 72. In addition, the outlet 74 is formed to be present in a surface on which the toner replenishing unit 52 of the developing device 5 is present at a position higher than the central axis of the cylindrical shape in the internal space 72.

The first connecting portion 75 includes a member having a passageway space 76 that extends from the inlet 73 of the main body portion 71 as a start point to reach the discharge port 184 of the toner receiving unit 18. The first connecting portion 75 in the first exemplary embodiment includes an angular cylindrical member protruding obliquely upward and outward from the position of the inlet 73 of the main body portion 71. In addition, the end of the first connecting portion 75 is formed as a connecting opening 75*b* having a shape connected with the discharge port 184 of the toner receiving unit 18.

The second connecting portion 77 includes a member having a passageway space 78 which extends from the outlet 74 of the main body portion 71 as a start point to reach the replenishing port 61 of the toner replenishing unit 52. The second connecting portion 77 in the first exemplary embodiment includes an angular cylindrical member protruding outward in the substantially horizontal direction from the position of the outlet 74 of the main body portion 71. In addition, the end of the second connecting portion 77 is formed as a connecting opening 77*b* having a shape connected with the replenishing port 61 of the toner replenishing unit 52 (in the present example, the upper end of the protruding portion 62).

(Configuration of Rotating Member)

Figure 5B:
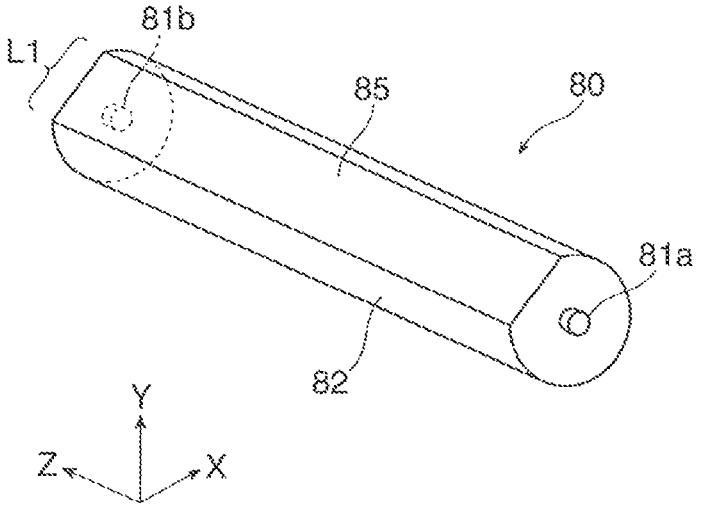
FIG. 5B is a schematic perspective view illustrating the rotating member in FIG. 5A.

As illustrated in, for example, FIGS. 2, 3, and 5, the rotating member 80, which configures the developing system 15, is a member that is disposed to be rotated in the internal space 72 of the main body portion 71 of the connecting member 70 and adjusts a transport state of the toner 17 in the connecting member 70.

The rotating member 80 is configured as a member that includes: a blocking surface portion 82 that is moved in a state of being in contact with the inner wall 72*a* of the internal space 72 having a cylindrical side surface shape, and brings at least one of the inlet 73 and the outlet 74 into a closed state when passing over at least one of the inlet 73 and the outlet 74; and a transport surface portion 85 that is spaced apart from the inner wall 72*a* of the internal space 72 having a cylindrical side surface shape to move while securing a space S, and receives or discharges the toner 17 when passing over the inlet 73 and the outlet 74.

For example, the rotating member 80 having the blocking surface portion 82 and the transport surface portion 85 is manufactured as a member having a shape that remains after cutting out a part of a lateral surface (outer circumferential surface) of a cylindrical base material into a plane parallel to the central axis. In this case, the remaining lateral part, which is not cut out, becomes the blocking surface portion 82, and the surface part, which is obtained by the cutting out, becomes the transport surface portion 85.

The blocking surface portion 82 is a portion having a curved surface that may be moved in the state of being in contact with the inner wall 72*a* of the internal space 72 of the main body portion 71. In addition, because the contact curved surface of the blocking surface portion 82 needs to bring at least one of the inlet 73 and the outlet 74 into a closed state when passing through at least one of the inlet 73 and the outlet 74, the contact curved surface of the blocking surface portion 82 has a portion having an area larger than the opening area of at least one of the inlet 73 and the outlet 74.

The contact curved surface of the blocking surface portion 82 in the first exemplary embodiment is configured as a surface having an area larger than the opening areas of both of the inlet 73 and the outlet 74. In addition, for example, as exemplified in FIGS. 7A to 7H, because the blocking surface portion 82 face the inlet 73 and the outlet 74 by the rotation of the rotating member 80, the blocking surface portion 82 may close at least one of the inlet 73 and the outlet 74.

The transport surface portion 85 is a portion having a surface that is spaced apart from the inner wall 72*a* of the internal space 72 of the main body portion 71 and may be moved while securing the space S required to receive and transport the toner 17. The space S is a part of the internal space 72, and a space defined by the surfaces that configures the inner wall 72*a* of the internal space 72 and the transport surface portion 85. In fact, the space S is a space used to temporarily accommodate and transport the toner 17. That is, the space S is connected with each of the inlet 73 and the outlet 74 when the transport surface portion 85 passes over the inlet 73 and the outlet 74. Thus, in more detail, when the transport surface portion 85 passes over the inlet 73, the space S is used as a space for receiving and accommodating the toner 17, when the transport surface portion 85 passes between the inlet 73 and the outlet 74, the space S is used as a space for transporting the accommodated toner 17, and when the transport surface portion 85 passes over the outlet 74, the space S is used as a space for discharging the accommodated and transported toner 17.

The transport surface portion 85 in the first exemplary embodiment has a flat surface having a rectangular shape with a length L1 of the short side (cut-out width). In addition, the transport surface portion 85 may have a structure in which arc-shaped side walls are present at the opposite ends in the direction of the central axis of the transport surface portion 85, for example, by mounting circular plates, which, have the same outer diameter as the outer diameter of the upper and bottom surfaces of the cylindrical shape, to the opposite side surfaces of the rotating member 80 which correspond to the upper and bottom surfaces of the cylindrical shape.

In addition, the rotating shafts 81*a* and 81*b* of the rotating member 80, which protrude at the central portions of the opposite side surfaces that correspond to the upper and bottom surfaces of the cylindrical shape, are rotatably mounted on the lateral surface portions of the internal space 72 of the main body portion 71. Further, the rotating member 80 is rotated in a predetermined direction indicated by an arrow J as a rotational power is transmitted from a rotation driving device (not illustrated) to a gear (not illustrated) mounted on one of the rotating shafts 81*a* and 81*b*.

The rotating member 80 rotates in conjunction with the operation timing of the developing device 5. For this reason, the rotational power of the rotating member 80 may be, for example, a rotational power transmitted by distributing a rotation power inputted to the developing device 5, rather than a rotational power from an independent rotation driving device. In addition, a rotational speed of the rotating member 80 is appropriately set in consideration of various conditions such as the transport timing of the toner 17 and the transport amount of the toner 17. In addition, the position of the rotating member 80 at the time of stopping the rotation is arbitrary, and is not particularly limited.

<Characteristic Operation of Developing System (Mainly, Operations by Connecting Member and Rotating Member)>

The developing system 15 including the connecting member 70 and the rotating member 80 performs characteristic operations to be described below.

First, in the developing system 15, at the operation timing of the developing device 5, the toner 17 is continuously transported from the toner receiving unit 18 to the toner replenishing unit 52 of the developing device 5 via the connecting member 70 as described above, and in the toner replenishing unit 52 of the developing device 5, the replenishing port 61 is opened and closed depending on the existence/non-existence of the developer such that the replenishing operation of the toner 17 is performed or stopped.

At this time, in the connecting member 70, the rotating member 80 continuously rotates in the direction indicated by the arrow J in the internal space 72 of the main body portion 71. As a result, a special transport of the toner 17 is performed as exemplified sequentially in time in FIGS. 7A to 7H.

Figures 7A, 7B, 7C, 7D, 7E, 7F, 7G, 7H:
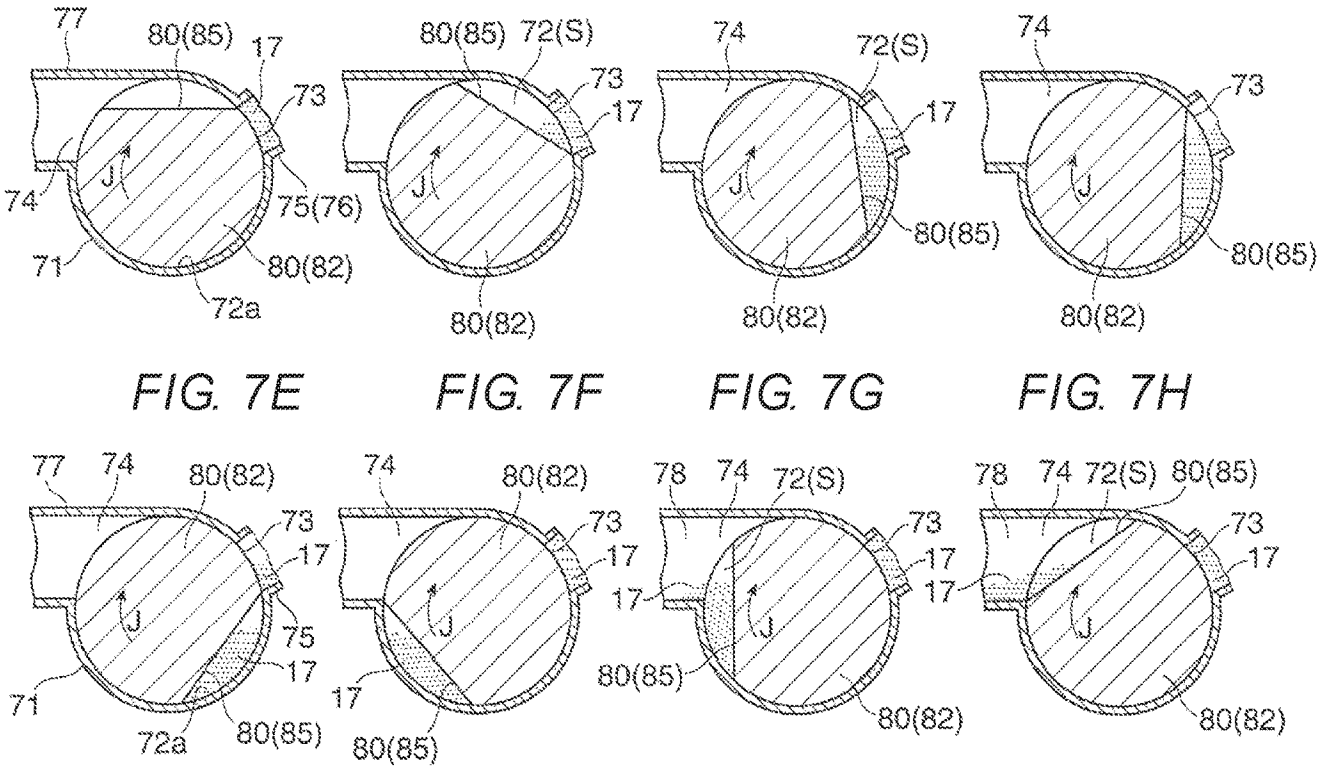
FIGS. 7A to 7H are schematic cross-sectional explanatory views illustrating sequentially in time states in which the connecting member and the rotating member of the developing system in FIG. 2 are operated.

First, at a time point exemplified in FIG. 7A, the rotating member 80 is in a state where the blocking surface portion 82 passes over the inlet 73 to close the inlet 73, thereby closing the inlet 73. At this time, the blocking surface portion 82 is in the state of closing a part of the outlet 74 and opening the remaining part of the outlet 74. In addition, the transport surface portion 85 in the rotating member 80 at this time point is at a position after completely passing over the outlet 74 and before passing over the inlet 73.

At this time, the toner 17, which is sent and transported from the discharge port 184 of the toner receiving unit 18, is present in the passageway space 76 of the first connecting portion 75 of the main body portion 71 of the connecting member 70. However, because the inlet 73 of the main body portion 71 is in a state of being closed by the blocking surface portion 82 of the rotating member 80, the toner 17 existing in the passageway space 76 of the first connecting portion 75 is placed in the state of being stopped in the passageway space 76 without moving any further.

Subsequently, at the time points (timing) exemplified in FIGS. 7B to 7D, the rotating member 80 is in a state where the blocking surface portion 82 opens the inlet 73 after completely passing over the inlet 73, and is in a state where the blocking surface portion 82 continuously closes the outlet 74 in the process of passing over the outlet 74 to close the outlet 74. In addition, the transport surface portion 85 is in the process of passing over the inlet 73.

At this time, while the transport surface portion 85 passes over the inlet 73, the space S in the transport surface portion 85 is in the state of being connected with the inlet 73. Therefore, the toner 17 existing in the passageway space 76 of the first connecting portion 75 is received by moving to flow into the space S of the transport surface portion 85. In addition, because the space S at this time moves to slowly pass over the inlet 73 by the rotation of the rotating member 80, the toner 17 is received to be slowly accumulated from the lower side (the leading side) of the space S. The reception of the toner 17 into the space S of the transport surface portion 85 is terminated at a time point at which the blocking surface portion 82 of the rotating member 80 completely closes the inlet 73 (see FIG. 7E). However, even before the blocking surface portion 82 of the rotating member 80 completely closes the inlet 73, that is, even at a time point at which the toner 17 in the passageway space 76 of the first connecting portion 75 does not move to the space S, the reception of the toner 17 into the space S of the transport surface portion 85 is terminated.

Subsequently, at time points (timing) exemplified in FIGS. 7E and 7F, the rotating member 80 is in a state where the blocking surface portion 82 passes over the inlet 73 to close the inlet 73 again, thereby closing the inlet 73, and is in the process of passing over the outlet 74 to close the outlet 74, thereby continuously closing the outlet 74. In addition, the transport surface portion 85 completely passes over the inlet 73 and is in the process of moving toward the outlet 74.

At this time, (the space S of) the transport surface portion 85 moves in the state of facing the inner wall 72*a* of the internal space 72 of the main body portion 71. Therefore, the toner 17, which is received and accommodated in the space S of the transport surface portion 85, is transported in a state of being held within the space S according to the movement of the transport surface portion 85. At this time, when an air gap in which no toner 17 is present exists in the space S, the toner 17 easily moves in the space S when the toner 17 is transported so that the toner 17 is efficiently loosened.

In addition, at this time, the blocking surface portion 82 is in a state of closing the inlet 73 of the main body portion 71. For this reason, the toner 17 existing in the passageway space 76 of the first connecting portion 75 is not accommodated in the space S through the inlet 73. Therefore, the toner 17 at the time of being held within the space S to be transported is not pushed by the subsequent toner 17 that is continuously received from the inlet 73. That is, the toner 17 at the time of being held in the space S to be transported is shut off from the phenomenon that the toner receives a transport force applied by the subsequent toner 17 that is continuously conveyed by receiving the transport force of the transport member 185 from the toner receiving unit 18.

Finally, at time points (timing) exemplified in FIGS. 7G and 7H, the rotating member 80 is in a state where the transport surface portion 85 is in the process of passing over the outlet 74. In addition, the blocking surface portion 82 starts to pass over the outlet 74 to open the outlet 74, and passes over the inlet 73 to continuously close the inlet 73, thereby closing the inlet 73.

At this time, the space S of the transport surface portion 85 is in the state of being connected with the outlet 74. Therefore, the toner 17, which has been held in the space S and transported, is discharged by moving to flow into the passageway space 78 of the second connecting portion 77 through the outlet 74.

At this time, as exemplified in FIG. 7H, there is a time period at which in the latter half of a period in which the transport surface portion 85 passes over the outlet 74, the plane of the transport surface portion 85 passes over the outlet 74 in the state of being inclined in a state where a rear end side of the plane is directed downward in an moving direction of the plane. Therefore, the toner 17 within the space S slides downward along the plane of the transport surface portion 85, which is inclined, and gently moves to the passageway space 78 of the second connecting portion 77.

Even at this time, since the blocking surface portion 82 is in the state of closing the inlet 73 of the main body portion 71, when the toner 17 within the space S is discharged to the passageway space 78 of the second connecting portion 77, the toner 17 is shut off from the phenomenon that the toner 17 receives a transport force applied by the subsequent toner 17 which is continuously conveyed by receiving the transport force of the transport member 185 from the toner receiving unit 18.

At this time, when a large amount of toner 17 is present in the passageway space 78 of the second connecting portion 77, the toner 17 existing in the space S of the transport surface portion 85 of the rotating member 80 is discharged by slightly moving into the passageway space 78 of the second connecting portion 77, or is not discharged by not moving at all. In this case, the toner 17 stopped within the space S of the transport surface portion 85 is transported in the state of being held within the space S by the rotation of the rotating member 80, so that the toner 17 is transported to the outlet 74 again to await an opportunity of discharge.

In the developing system 15, when the new toner 17 is transported from (the discharge port 184 of) the toner receiving unit 18 to the toner replenishing unit 52 of the developing device 5, the above-described special transport of the toner 17 is repeated as the rotating member 80 rotates within the internal space 72 of the main body portion 71 of the connecting member 70.

Figure 8:
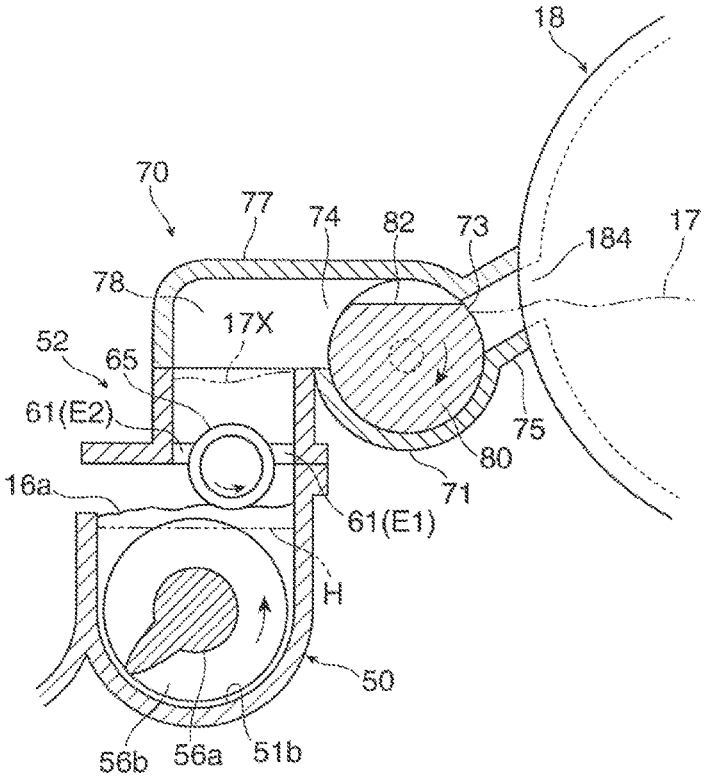
FIG. 8 is a main part cross-sectional explanatory view illustrating a state at a specific timing while toner is transported from a toner receiving unit to the toner replenishing unit of the developing device via the connecting member and the rotating member in the developing system in FIG. 2.

In the developing system 15, the toner 17, which has been transported by being discharged to the passageway space 78 of the second connecting portion 77 of the connecting member 70, is moved through the passageway space 78, and transported to (the replenishing port 61 of) the toner replenishing unit 52 of the developing device 5, as illustrated in FIG. 8.

At this time, the toner 17, which has been transported to the replenishing port 61 of the toner replenishing unit 52, is accumulated as the toner reservoir 17X on the replenishing port 61, as described above, when the replenishing port 61 is in the closed state. Meanwhile, when the replenishing port 61 is in the opened state, a part or the entirety of the transported toner 17 passes through (the gap E2 of) the replenishing port 61, and is replenished to the accommodating portion 51 of the developing device 5.

In addition, in the developing system 15, when the toner 17 is discharged from the discharge port 184 of the toner receiving unit 18, the toner 17 is continuously sent to the connecting member 70 side by receiving the transport force of a certain degree applied by the transport member 185.

However, in the developing system 15, since the blocking surface portion 82 of the rotating member 80 rotating in the internal space 72 of the main body portion 71 of the connecting member 70 closes one of the inlet 73 or the outlet 74 of the main body portion 71, the transport force of the toner 17 from the toner receiving unit 18 is temporarily blocked (e.g., the states exemplified in FIGS. 7B to 7H) due to the presence of (the blocking surface portion 82 of) the rotating member 80.

For this reason, when the toner 17 is transported from the toner receiving unit 18 toward the toner replenishing unit 52 of the developing device 5 via the connecting member 70, the toner 17 does not continuously receive the transport force applied by the transport member 185 from the toner receiving unit 18 (through the movement of the subsequent toner 17).

As a result, in the developing system 15, when the toner 17 is transported toward the toner replenishing unit 52 of the developing device 5, the toner 17 is not continuously pressed against, particularly, an inner wall, which configures the passageway space 78 of the second connecting portion 77 which is responsible for connection with the toner replenishing unit 52, or an inner wall of the protruding portion 62 of the toner replenishing unit 52. Therefore, there is no concern that a part of the toner 17 will adhere to the respective inner walls and the like (adhesion is inhibited). Therefore, the toner 17, which is transported toward the toner replenishing unit 52, is normally replenished to the accommodating portion 51 without a loss caused by the adhesion.

In addition, in the developing system 15, because the toner 17, which is transported toward the toner replenishing unit 52 of the developing device 5, is not continuously pressed against the replenishing port 61 which is in a closed state by the developer 16*b* (strictly speaking, the magnetic brush) in the toner replenishing unit 52, for example, there is no concern that the toner 17 will unexpectedly pass through the gap E2 of the replenish ng port 61 (the toner 17 is suppressed from unexpectedly passing through the replenishing port 61). Therefore, there is no concern that the toner 17, which is transported toward the toner replenishing unit 52, unexpectedly passes through the replenishing port 61 to be excessively replenished to the accommodating portion 51 of the developing device 5, and the toner 17 is normally replenished to the accommodating portion 51.

Reference Comparative Example 1

Figure 16:
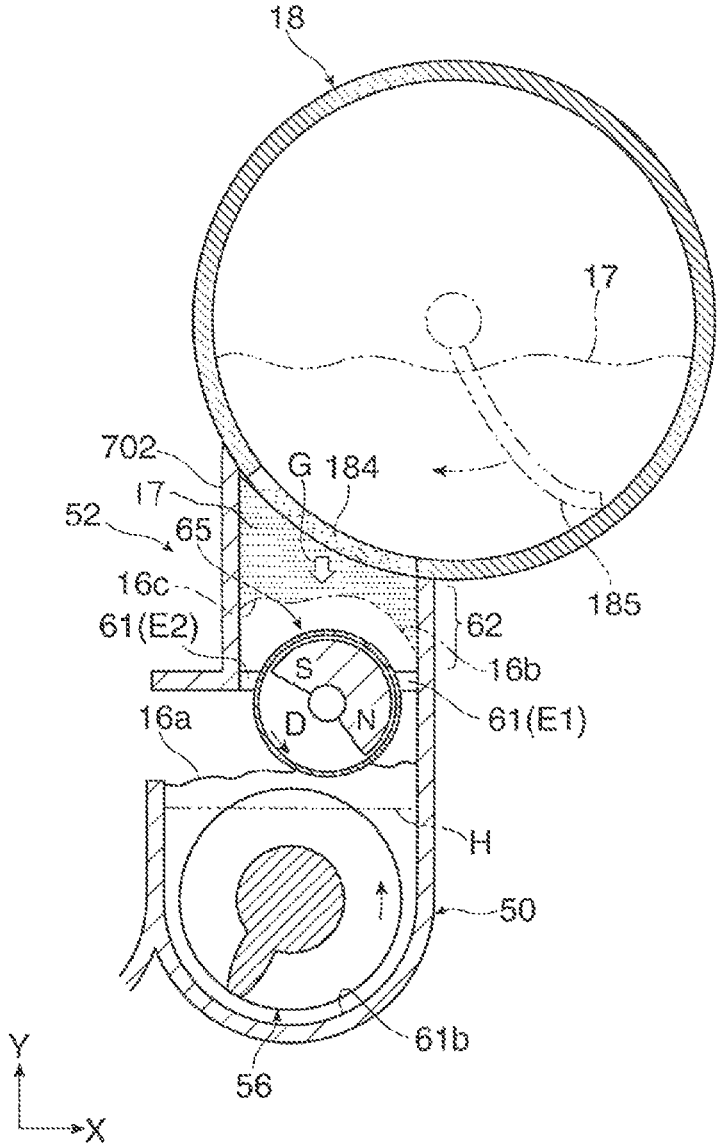
FIG. 16 is a main part cross-sectional explanatory view illustrating one configuration example (Reference Comparative Example 1) of a positional relationship between the toner receiving unit and the toner replenishing unit of the developing device.

Here, for example, as exemplified in FIG. 16, in a case in which the toner receiving unit 18 is disposed at a position above the toner replenishing unit 52 of the developing device 5 (at a position almost immediately above the toner replenishing unit 52), and the discharge port 184 of the toner receiving unit 18 and the replenishing port 61 of the toner replenishing unit 52 are connected by a connecting member 702 of which the passageway space extends in a vertical direction (a direction following the coordinate axis Y) (Reference Comparative Example 1), it is possible to transport the toner 17 to the replenishing port 61 of the toner replenishing unit 52 by dropping the toner 17 in the toner receiving unit 18 almost by an own weight of the toner 17 (gravity G) from the discharge port 184 through the passageway space of the connecting member 702.

For this reason, in the case of Reference Comparative Example 1 (FIG. 16), because the toner 17, which is transported from the toner receiving unit 18 to the toner replenishing unit 52 through the connecting member 702, is not continuously pressed against an inner wall which configures the passageway space of the connecting member 702, or the inner wall of the protruding portion 62 of the toner replenishing unit 52, or the toner 17 is not strongly pressed toward the replenishing port 61, there is no concern that a part of the toner 17 adheres to the inner walls, or unexpectedly passes through the gap E2 of the replenishing port 61.

However, even in the case of Reference Comparative Example 1, for example, when the transport force of the toner 17 applied by the transport member 185 disposed in the toner receiving unit 18 is set to be comparatively high and the transport force is applied to the replenishing port 61 of the toner replenishing unit 52 through the passageway space of the connecting member 702, there is concern that a part of the toner 17 adheres to the inner walls or unexpectedly passes through the gap E2 of the replenishing port 61.

Reference Comparative Example 2

Figure 17:
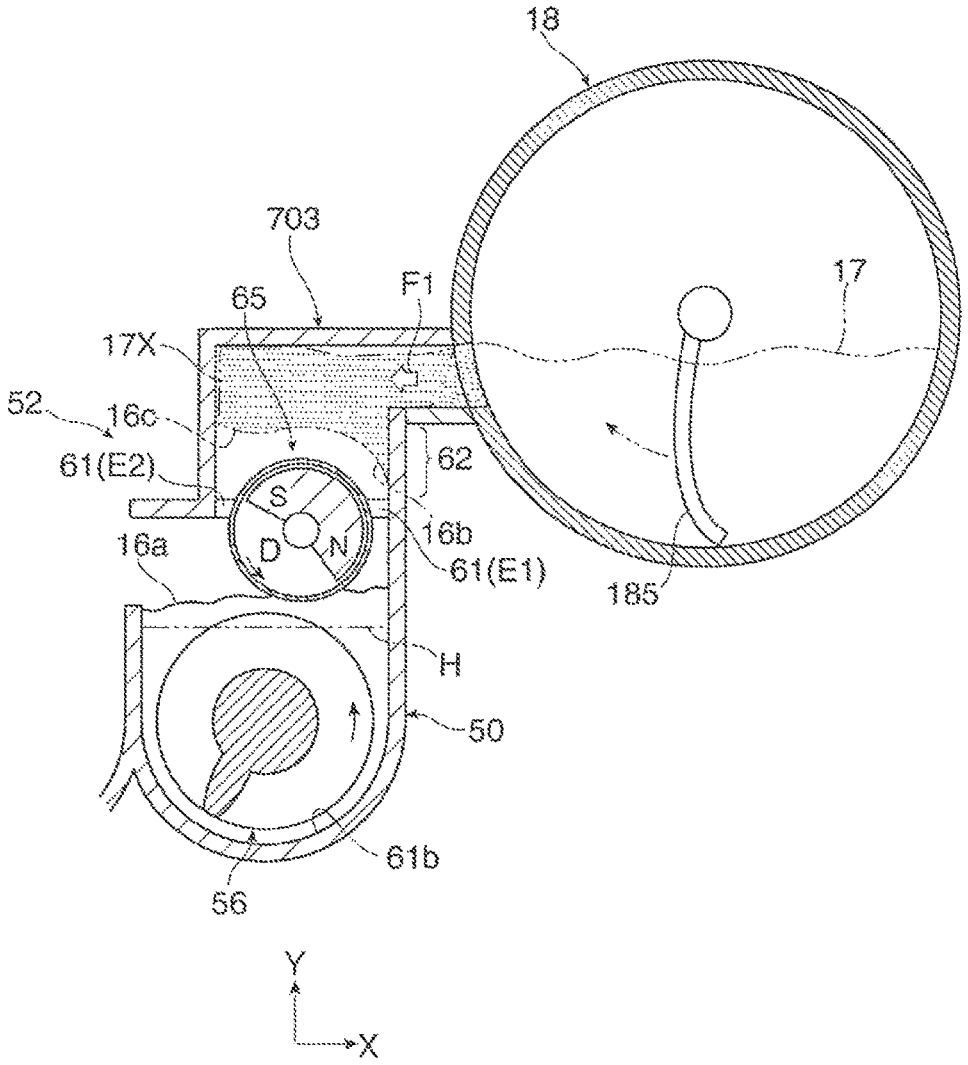
FIG. 17 is a main part cross-sectional explanatory view illustrating another configuration example (Reference Comparative Example 2) of a positional relationship between the toner receiving unit and the toner replenishing unit of the developing device.

Meanwhile, as illustrated in FIG. 17, in a case in which the toner receiving unit 18 is disposed at a position above the toner replenishing unit 52 of the developing device 5 (at a position almost immediately above the toner replenishing unit 52), and the discharge port 184 of the toner receiving unit 18 and the replenishing port 61 of the toner replenishing unit 52 are connected only by a connecting member 703 of which the passageway space extends in an almost horizontal direction (Reference Comparative Example 2), the toner 17 in the toner receiving unit 18 needs to reach the toner replenishing unit 52 by moving through the passageway space of the connecting member 703 which extends in the horizontal direction, and as a result, it is necessary to set a transport force of the toner 17, which is applied by the transport member 185 disposed in the toner receiving unit 18, to be comparatively high.

For this reason, in the case of Reference Comparative Example 2, because the toner 17, which is transported from the toner receiving unit 18 to the toner replenishing unit 52 through the connecting member 703, continuously receives the transport force (F1) of the toner 17, which is applied by the transport member 185, the toner 17 may be pressed against an inner wall which configures the passageway space of the connecting member 703, or the inner wall of the protruding portion 62 of the toner replenishing unit 52, and in some cases, the toner 17 may be strongly pressed toward the replenishing port 61. As a result, a part of the toner 17 adheres to toe inner walls, and unexpectedly passes through the gap E2 of the replenishing port 61 in some cases.

In this regard, since the developing system 15 according to the first exemplary embodiment adopts the configuration in which the rotating member 80 is disposed in the connecting member 70, the toner is prevented or inhibited from adhering or unexpectedly passing through the gap E2 of the replenishing port 61.

Second Exemplary Embodiment

Figure 9:
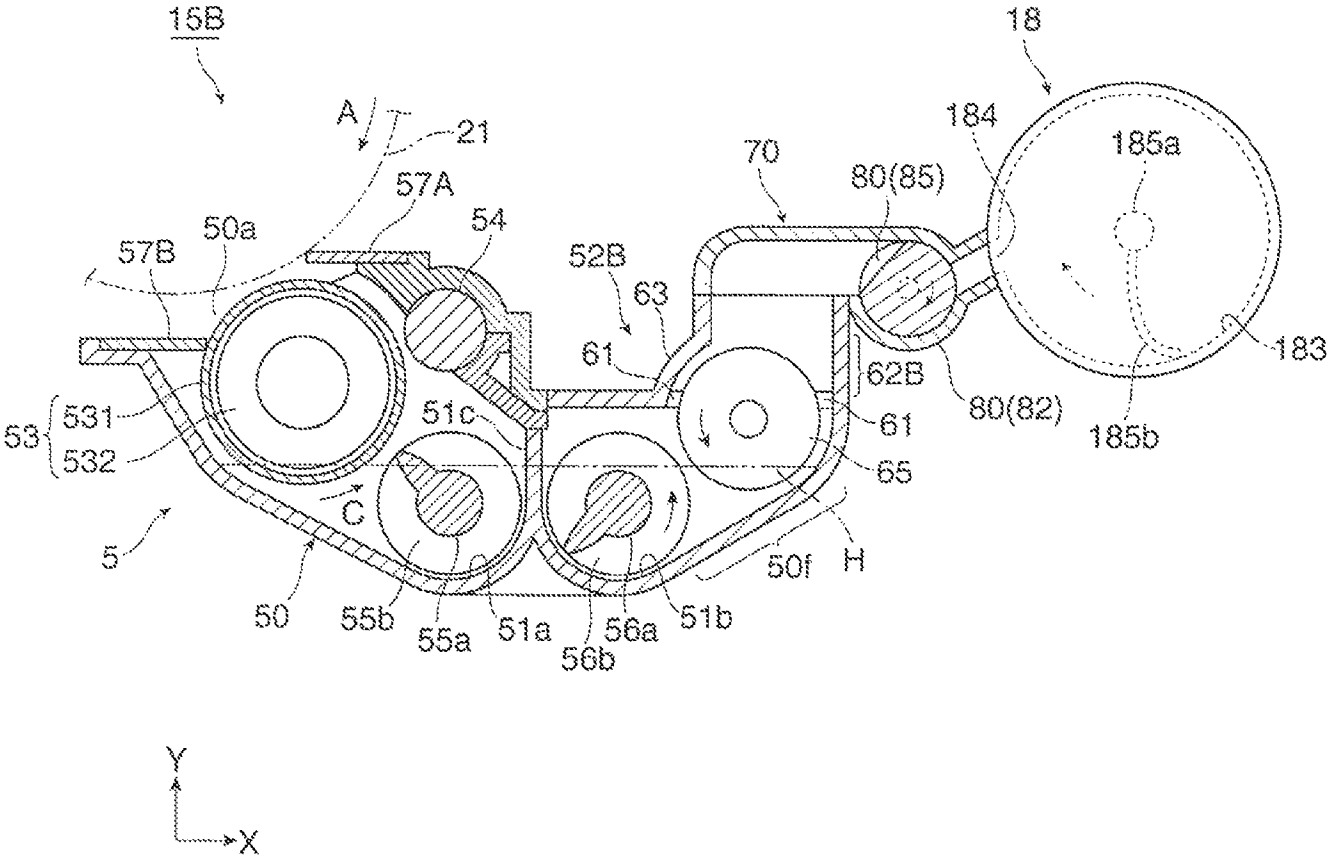
FIG. 9 is a cross-sectional explanatory view conceptually illustrating a developing system according to a second exemplary embodiment.
Figure 10:
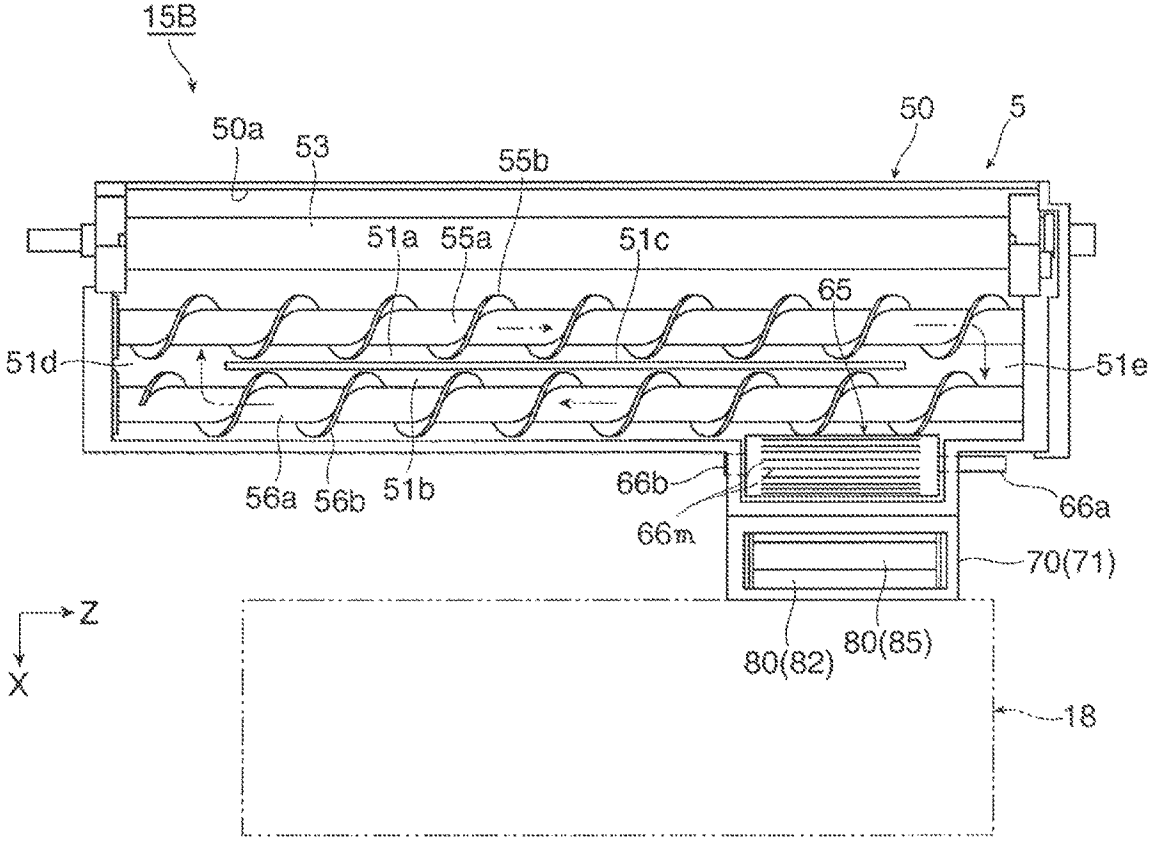
FIG. 10 is a top plan explanatory view conceptually illustrating a part of the developing system in FIG. 9.

FIGS. 9 and 10 are views illustrating a developing system according to a second exemplary embodiment. FIG. 9 is a partial cross-sectional view illustrating a configuration of the developing system, and FIG. 10 is a partial plan view illustrating a part of the configuration of the developing system.

A developing system 15B according to the second exemplary embodiment has the same configuration as the developing system 15 according to the first exemplary embodiment, except that the developing system 15B according to the second exemplary embodiment adopts a toner replenishing unit 52B having a configuration slightly different from the configuration of the toner replenishing unit 52 of the developing device 5 in the first exemplary embodiment.

(Configuration of Toner Replenishing Unit)

As illustrated in FIGS. 9 and 10, in the toner replenishing unit 52B of the developing system 15B, the replenishing port 61 is formed at an upper side of an overhanging portion 50*f*, which overhangs to protrude obliquely upward opposite to the first transport path 51*a*, in a part of the second transport path 51*b* of the accommodating portion 51 of the developing device 5, and the rotating body 65 is provided to be adapted to the replenishing port 61 of which the disposition position is changed. The overhanging portion 50*f* is formed at a position shifted to an upstream side in a developer transport direction in the second transport path 51*b*.

Similarly to the replenishing port 61 in the first exemplary embodiment, the replenishing port 61 of the toner replenishing unit 52B is formed as an opening of which the planar shape is rectangular. In addition, the replenishing port 61 is formed to be present at a lower end of an angular cylindrical protruding portion 62B provided to protrude by a predetermined height from the upper side of the case 50. However, the protruding portion 62B has an angular cylindrical shape which is reduced in size so that in the upper portion of the protruding portion 62B, a portion in the vicinity of the second transport path 51*b* has a dimension smaller than a dimension of a short side of the replenishing port 61, and in the lower portion of the protruding portion 62B, a portion in the vicinity of the second transport path 51*b* is formed, due to the reduction in size, as a curved surface portion 63 which is curved in an arc shape along an outer circumferential surface of the rotating body 65 (cylindrical member 66).

In the rotating body 65 of the toner replenishing unit 52B, the cylindrical member 66 is rotatably mounted on sidewall portions of the overhanging portion 50*f* through the shaft portions 66*a* and 66*b* provided at the opposite end portions of the cylindrical member 66 in the direction of the rotation axis. In addition, the cylindrical member 66 of the rotating body 65 is rotated in the predetermined direction D as a gear (not illustrated) is mounted at an end portion of the shaft portion 66*a* and a rotational power distributed from (the rotating shaft 56*a* of) the agitation transport member 56 is transmitted to the gear.

Figure 11:
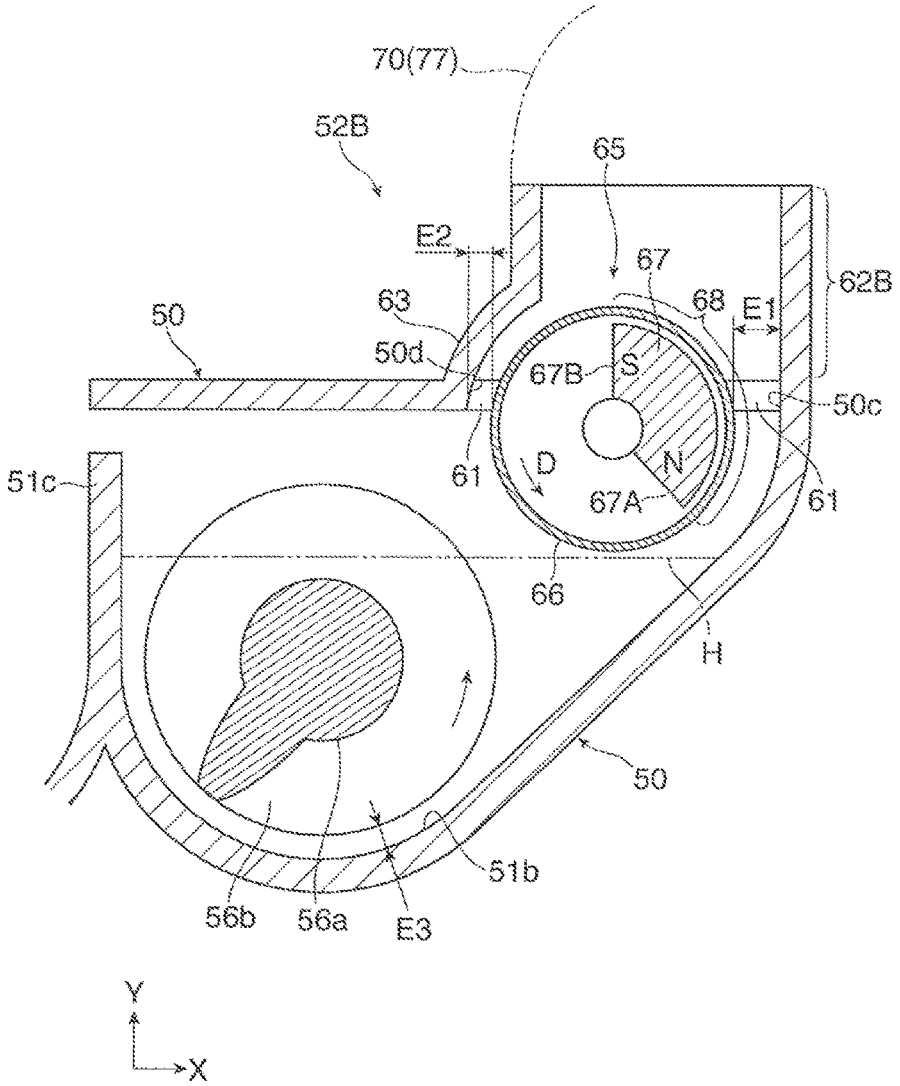
FIG. 11 is a cross-sectional explanatory view illustrating a configuration of a toner replenishing unit of a developing device of the developing system in FIG. 9 in an enlarged scale.

As illustrated in, for example, FIG. 11, when viewed downward from the upper side of the developing device 5, the cylindrical member 66 of the rotating body 65 is disposed to form a first gap E1 with the replenishing port 61 (the rear wall surface 50*c* of the case which configures the replenishing port 61) at the upstream side of the outer circumferential surface of the cylindrical member 66 in the rotation direction D, and a second gap E2 with the replenishing port 61 (the front wall surface 50*d* of the case which configures the replenishing port 61) at the downstream, side of the outer circumferential surface of the cylindrical member 66 in the rotation direction D.

(Configurations of Connecting Member and Rotating Member)

Similarly to the developing system 15 according to the first exemplary embodiment (For example, FIG. 2), in the developing system 15B, as illustrated in, for example, FIG. 9, the toner replenishing unit 52B of the developing device 5 and the toner receiving unit 18 are connected by the connecting member 70, and the rotating member 80 is provided in the internal space 72 of the main body portion 71 of the connecting member 70.

(Basic Operations of Toner Replenishing Unit and Toner Receiving Unit)

In the developing device 5 having the toner replenishing unit 52B in the developing system 15B, at the operation timing of the developing device 5, the rotating body 65 starts to rotate in conjunction with the start of the developing device 5, and the transport member 185 of the toner receiving unit 18 also starts to rotate.

Therefore, the toner 17 accommodated in the toner receiving unit 18 is discharged from the discharge port 184 by a transport force of the transport member 185, and then transported to the toner replenishing unit 52B via the connecting member 70.

At this time, the toner 17 is continuously conveyed from the toner receiving unit 18 to the toner replenishing unit 52B via the connecting member 70. For this reason, in the toner replenishing unit 52B, the toner 17 is reserved by the amount existing in the space inside the replenishing port 61 (in fact, a space surrounded by the protruding portion 62B) to form a toner reservoir 17*X* (see, for example, FIGS. 12A and 12B).

Figure 12B:
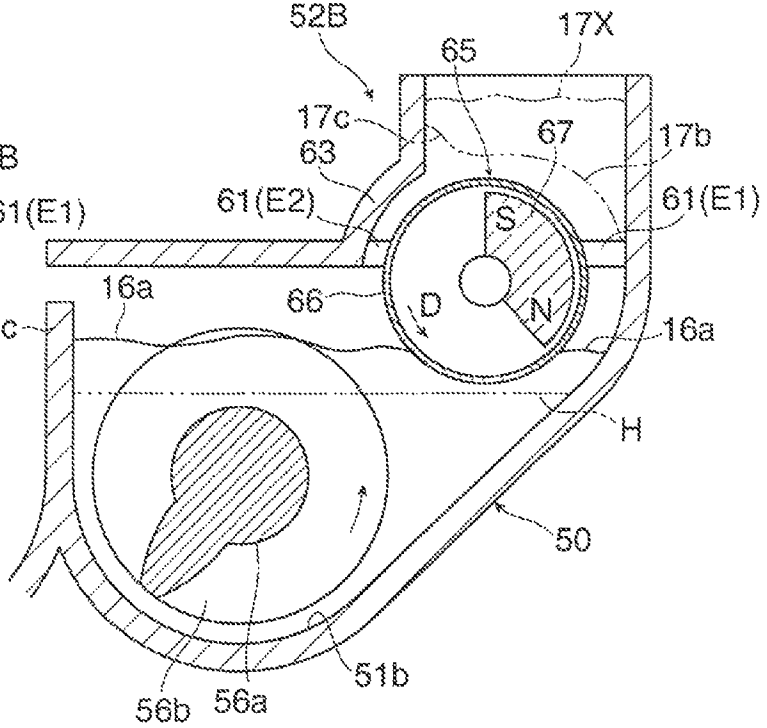
FIG. 12B is a main part cross-sectional explanatory view illustrating a state in which the toner replenishing unit in FIG. 11 is operated at a different specific timing.
Figure 12A:
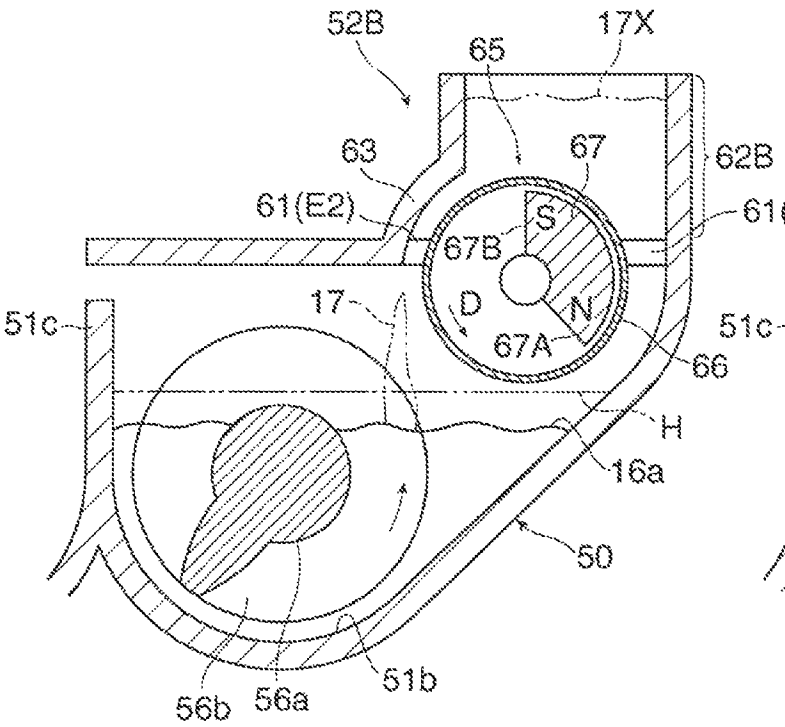
FIG. 12A is a main part cross-sectional explanatory view illustrating a state in which the toner replenishing unit in FIG. 11 is operated at a specific timing.

In addition, as exemplified in FIG. 12A, the toner 17 in the toner replenishing unit 52B is consumed according to the developing operation of the developing device 5 so that the upper surface 16*a* of the developer accommodated in the accommodating portion 51 may be lowered to be equal to or lower than the reference height H.

In this case, as in the case of the toner replenishing unit 52 in the first exemplary embodiment, the developer in the accommodating portion 51 is not transported to the replenishing port 61 by the rotating body 65, and the developer does not remain in the second gap E2 between the replenishing port 61 and the rotating body 65. Thus, the replenishing port 61 is in an opened state.

As a result, in the toner replenishing unit 52B, the replenishing toner 17 including the toner 17, which has become the toner reservoir 17X in the replenishing port 61, passes through the second gap E2 of the replenishing port 61 by receiving gravity and the rotational transport force of the rotating body 65, and are replenished to be dropped into the second transport path 51*b* of the accommodating portion 51.

On the contrary, as illustrated in FIG. 12B, in the toner replenishing unit 52B, the upper surface 16*a* of the developer accommodated in the accommodating portion 51 may be raised and exceed the reference height H due to the replenishment of the toner 17 in some cases.

In this case, similarly to the toner replenishing unit 52 in the first exemplary embodiment, the part 16*b* of the developer in the accommodating portion 51 is transported to the replenishing port 61 and also passes through the first gap E1 by the rotating body 65, and the developer 16*b* finally remains in the second gap E2 between the replenishing port 61 and the rotating body 65 (the remaining developer 16*c*). Thus, the replenishing port 61 (in fact, both the gaps 51 and 52) is clogged and is in a closed state by the presence of the developer 16*b* which is held and transported by the rotating body 65.

As a result, in the toner replenishing unit 52B, because the replenishing toner 17 including the toner 17, which has become the toner reservoir 17X in the replenishing port 61, is not able to pass through the second gap E2 clogged by the developer 16*b* transported by the rotating body 65, the replenishment of the toner 17 into the second transport path 51*b* of the accommodating portion 51 is stopped.

<Characteristic Operation of Developing System (Mainly, Operations by Connecting Member and Rotating Member>

Similarly to the developing system 15 according to the first exemplary embodiment, the developing system 15B performs characteristic operations to be described below.

First, even in the developing system 15B, at the operation timing of the developing device 5, the toner 17 is continuously transported from the toner receiving unit 18 to the toner replenishing unit 52B of the developing device 5 via the connecting member 70 as described above, and in the toner replenishing unit 52B of the developing device 5, the replenishing port 61 is opened and closed depending on the existence/non-existence of the developer such that the replenishing operation of the toner 17 is performed or stopped.

In the connecting member 70 of the started developing system 15B, the rotating member 80 continuously rotates in the direction indicated by the arrow J in the internal space 72 of the main body portion 71. Thus, as in the connecting member 70 and the rotating member 80 in the first exemplary embodiment, a special transport of the toner 17 is performed as exemplified sequentially in time in FIGS. 7A to 7H.

As in the developing system 15 according to the first exemplary embodiment, even in the developing system 15B, when the toner 17 is discharged from the discharge port 184 of the toner receiving unit 18, the toner 17 is continuously sent to the connecting member 70 by receiving a certain degree of transport force applied by the transport member 185.

However, even in the developing system 15B, since the blocking surface portion 82 of the rotating member 80 rotating in the internal space 72 of the main body portion 71 of the connecting member 70 closes one side of the inlet 73 or the outlet 74 of the main body portion 71, the transport force of the toner 17 from the toner receiving unit 18 is temporarily blocked (e.g., the states exemplified in FIGS. 7B to 7H) due to the presence of (the blocking surface portion 82 of) the rotating member 80.

For this reason, when the toner 17 is transported from the toner receiving unit 18 toward the toner replenishing unit 52B of the developing device 5 via the connecting member 70, the toner 17 does not continuously receive transport force applied by the transport member 185 from the toner receiving unit 18 (through the movement of the subsequent toner 17).

As a result, even in the developing system 15B, because the toner 17, which is transported toward the toner replenishing unit 52B of the developing device 5, is not continuously pressed against, particularly, an inner wall, which configures the passageway space 78 of the second connecting portion 77 which is responsible for connection with the toner replenishing unit 52B, or an inner wall of the protruding portion 62B of the toner replenishing unit 52B, there is no concern that a part of the toner 17 adheres to the respective inner walls and the like. Therefore, the toner 17, which is transported toward the toner replenishing unit 52B, is normally replenished into the accommodating portion 51 without a loss caused by the adhesion.

Even in the developing system 15B because the toner 17, which is transported toward the toner replenishing unit 52B of the developing device 5, is not continuously pressed against the replenishing port 61 which is in a closed state by the developer 16*b* in the toner replenishing unit 52B, for example, there is no concern that the toner 17 unexpectedly passes through the gap E2 of the replenishing port 61. Therefore, there is no concern that the toner 17, which is transported toward the toner replenishing unit 52B unexpectedly passes through the replenishing port 61 to be excessively replenished to the accommodating portion 51 of the developing device 5, and the toner 17 is normally supplied into the accommodating portion 51.

Third Exemplary Embodiment

Figure 13:
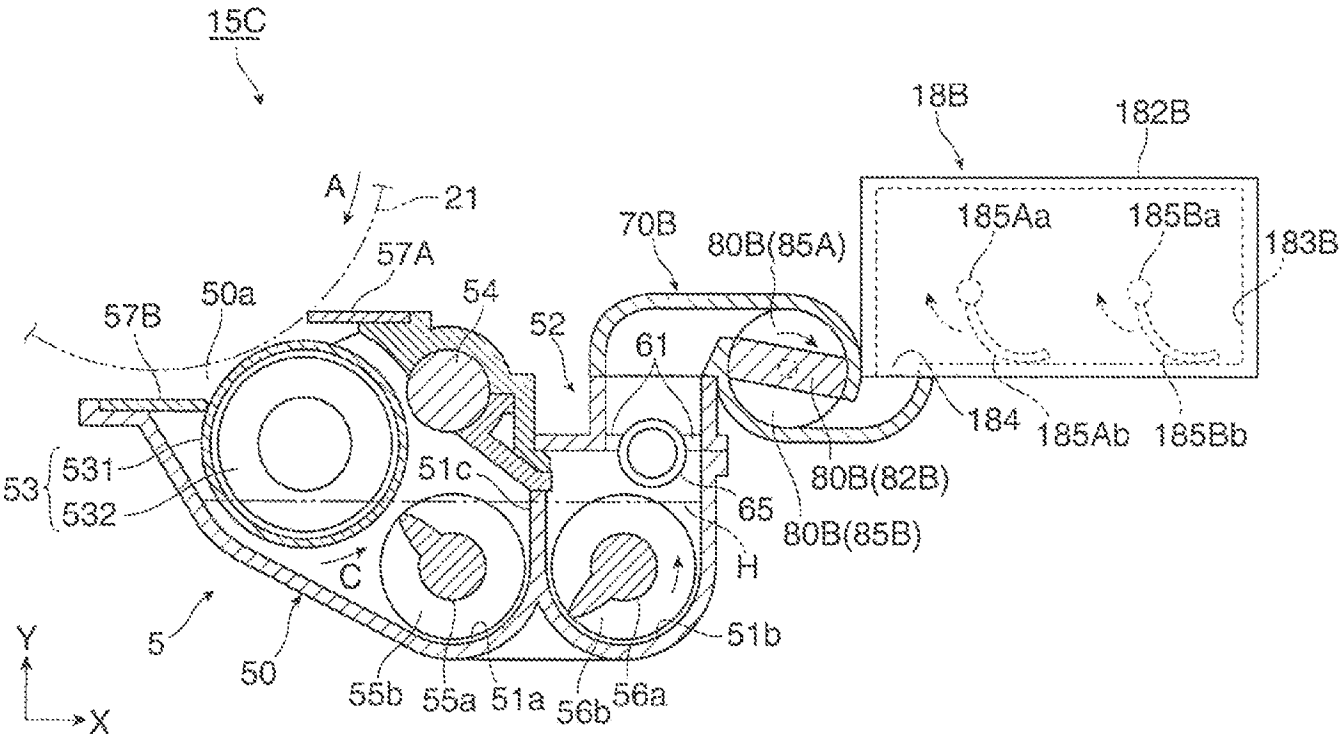
FIG. 13 is a cross-sectional explanatory view conceptually illustrating a developing system according to a third exemplary embodiment.

FIG. 13 is a view illustrating a developing system according to a third exemplary embodiment.

A developing system 15C according to the third exemplary embodiment has the same configuration as the developing system 15 according to the first exemplary embodiment, except that the developing system 15C according to the third exemplary embodiment adopts a toner receiving unit 18B, a connecting member 70B, and a rotating member 80B which have configurations slightly different from the configurations of the toner receiving unit 18, the connecting member 70, and the rotating member 80 in the first exemplary embodiment.

(Configuration of Toner Receiving Unit)

As illustrated in FIG. 13, the toner receiving unit 18B is disposed to be present at a position deviated from the toner replenishing unit 52 of the developing device 5 in a horizontal direction. Almost like the first exemplary embodiment, in the third exemplary embodiment, the toner receiving unit 18B is disposed at a position spaced apart from the toner replenishing unit 52 of the developing device 5 obliquely upward in a direction opposite to the side where the developing roller 53 is present.

The toner receiving unit 18B is different from the toner receiving unit 18 in the first exemplary embodiment, in that as illustrated in FIG. 13, a container having an accommodating space 183B having an angular column shape applied as an accommodating container 182B, a discharge port 184 is formed at one end of a bottom surface portion of the accommodating space 183B, and two transport members 185A and 185B are disposed within the accommodating container 182B.

The discharge port 184 formed at a position corresponding to the replenishing port 61 of the toner replenishing unit 52 of the developing device 5, and even in the third exemplary embodiment, the discharge port 184 is formed at an end portion of the bottom portion of the angular column shape of the accommodating space 183B which is in the vicinity of the developing device 5, that is, a portion in the vicinity of one end in a longitudinal direction of the bottom portion. In addition, the discharge port 184 has a rectangular opening shape.

(Configuration of Connecting Member)

Figure 14A:
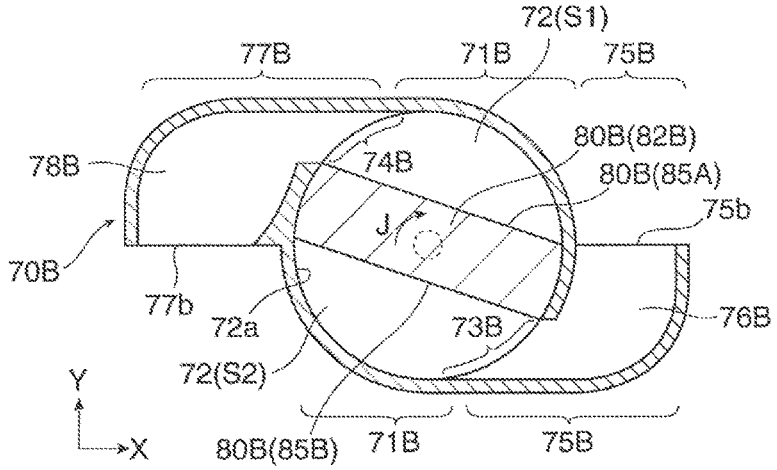
FIG. 14A is a cross-sectional explanatory view illustrating configurations of a connecting member and a rotating member of the developing system in FIG. 13.

As illustrated in, for example, FIGS. 13 and 14A, the connecting member 70B is a member which is provided between the toner replenishing unit 52 of the developing device 5 and the toner receiving unit 18B, and provides a transport path for transporting the toner 17 in the toner receiving unit 18B to the toner replenishing unit 52.

The connecting member 70B is different from the connecting member 70 in the first exemplary embodiment in that a main body portion in which positions where an inlet 73B and an outlet 74B are formed are changed is applied as a main body portion 71B, and a first connecting portion 75B for connecting the inlet 73B of the main body portion 71B and the discharge port 184 of the toner receiving unit 18B and a second connecting portion 77B for connecting the outlet 74B of the main body portion 71B and the replenishing port 61 of the toner replenishing unit 52 are applied.

The inlet 73B of the main body portion 71B is formed to be present in a surface where the toner receiving unit 18B is present, at a position where the internal space 72 of the main body portion 71B occupies a lower half portion below a central axis of the cylindrical shape. In addition, the outlet 74B of the main body portion 71B is formed to be present in a surface where the toner replenishing unit 52 of the developing device 5 is present, at a position where the internal space 72 occupies an upper half portion above the central axis of the cylindrical shape. The inlet 73B and the outlet 74B are disposed at portions of the inner wall 72*a* of the internal space 72 of the main body portion 71B which are almost point-symmetrical to each other based on the central axis having the cylindrical shape in the internal space 72.

The first connecting portion 75B includes an angular cylindrical member protruding outward in the almost horizontal direction from the position of the inlet 73B of the main body portion 71B. In addition, the first connecting portion 75B has therein a passageway space 76B, and an end thereof is formed as a connecting opening 75*b* that is formed in a shape that approaches the discharge port 184 of the toner receiving unit 18B from a lower side of the discharge port 184, and is connected with the discharge port 184.

The second connecting portion 77B includes an angular cylindrical member protruding outward in the almost horizontal direction from the position of the outlet 74B of the main body portion 71B. In addition, the second connecting portion 77B has therein a passageway space 78B, and an end thereof is formed as a connecting opening 77*b* that is formed in a shape that approaches the replenishing port 61 of the toner replenishing unit 52 (in the present example, an upper end of the protruding portion 62) from an upper side of the replenishing port 61, and is connected with the replenishing port 61.

(Configuration of Rotating Member)

Figure 14B:
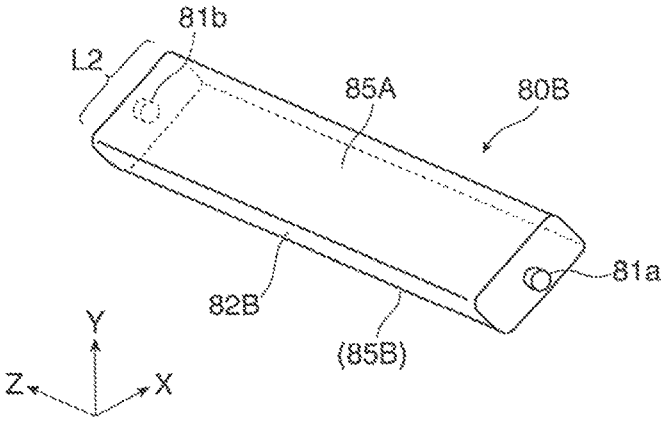
FIG. 14B is a schematic perspective view illustrating the rotating member in FIG. 14A.

As illustrated in, for example, FIG. 13 and FIGS. 14A and 14B, the rotating member 80B is configured as a member that includes a blocking surface portion 82B which has two blocking surfaces 82Ba and 82Bb, and two transport surface portions 85A and 85B which move while securing two spaces S1 and S2.

For example, the rotating member 80B having the blocking surface portion 82B and the two transport surface portions 85A and 85B is manufactured as a member having a shape that remains after cutting out a part of a lateral surface (outer circumferential surface) of a base material having cylindrical shape into two planes parallel to the central axis. In this case, the two lateral parts (blocking surfaces 82Ba and 82Bb), which remain without being cut out, become the blocking surface portion 82B, and the two planar portions, which are obtained by cutting, become the two transport surface portions 85A and 85B. For this reason, the rotating member 80B becomes a member that is entirely formed in a plate shape.

Each of the blocking surfaces 82Ba and 82Bb of the blocking surface portion 82B has a curved surface having an arc-shaped cross-sectional shape which may move while being in contact with the inner wall 72*a* of the internal space 72 of the main body portion 71B. Further, each of the blocking surfaces 82Ba and 82Bb has a surface with an area larger than the opening area of each of the inlet 73B and the outlet 74B.

For example, each of the two transport surface portions 85A and 85B has a flat surface having a rectangular shape with a length 12 of the short side (cut-out width).

The position of the rotating member 80B at the time of stopping the rotating member 80B is arbitrary, and is not particularly limited.

<Characteristic Operation of Developing System (Mainly, Operations by Connecting Member and Rotating Member>

The developing system 15C including the toner receiving unit 18B, the connecting member 70B, and the rotating member 80B performs characteristic operations to be described below.

First, in the developing system 15C, at the operation timing of the developing device 5, the toner 17 is continuously transported from the toner receiving unit 18B to the toner replenishing unit 52 of the developing device 5 via the connecting member 70B as described above, and in the toner replenishing unit 52 of the developing device 5, the replenishing port 61 is opened and closed in accordance with the existence/non-existence of the developer such that the replenishing operation of the toner 17 is performed or stopped.

At this time, in the connecting member 70B, when the rotating member 80B continuously rotates in the direction indicated by the arrow J in the internal space 72 of the main body portion 71B, a special transport of the toner 17 is performed as exemplified sequentially in time in FIGS. 15A to 15H.

First, at a time point exemplified in FIG. 15A, the rotating member 80B is in a state where the blocking surfaces 82Ba and 82Bb of the blocking surface portion 82B pass over the inlet 73B and the outlet 74B to simultaneously close both of the inlet 73B and the outlet 74B, thereby closing the inlet 73B and the outlet 74B. In addition, the two transport surface portions 85A and 85B of the rotating member 80B at this time point completely pass over both of the inlet 73B and the outlet 74B, and each of the transport surface portions 85A and 85B faces the inner wall 72*a* of the internal space 72.

At this time, the toner 17, which is sent and transported from the discharge port 184 of the toner receiving unit 18B, is present in the passageway space 76B of the first connecting portion 75B of the main body portion 71B of the connecting member 70B. However, because the inlet 73B of the main body portion 71B is in a state of being closed by the blocking surface 82Ba of the blocking surface portion 82B of the rotating member 80B, the toner 17 existing in the passageway space 76B of the first connecting portion 75B is in a state of being stopped in the passageway space 76B without moving any further.

Subsequently, at time points (timing) exemplified in FIGS. 15A to 15D, the rotating member 80B in a state where the blocking surfaces 82Ba and 82Bb of the blocking surface portion 82B completely pass over both of the inlet 73B and the outlet 74B, and thus open the inlet 73B and the outlet 74B. In addition, the transport surface portion 85A is in the process of passing over the inlet 73B. In addition, the other transport surface portion 85B at this time is in the process of passing over the outlet 74B.

At this time, while the transport surface portion 85A passes over the inlet 73B, the space S1 of the transport surface portion 85A is in the state of being connected with the inlet 73B. Therefore, the toner 17 existing in the passageway space 76B of the first connecting portion 75B is moved to flow into the space S1 of the transport surface portion 85A and received by the space S1 of the transport surface portion 85A. The reception of the toner 17 into the space S1 of the transport surface portion 85A is terminated at a time point where the blocking surface 82Ba of the blocking surface portion 82B of the rotating member 80B closes the inlet 73B (see FIG. 15E). However, even before the blocking surface portion 82B closes the inlet 73B, the reception of the toner 17 into the space S1 of the transport surface portion 85A is also terminated at a time point where the toner 17 in the passageway space 76B of the first connecting portion 75B does not move to the space S1.

Subsequently, at time points (timing) exemplified in FIGS. 15E and 15F, the rotating member 80B is in a state where the blocking surface 82Ba of the blocking surface portion 82B passes over the inlet 73B to close the inlet 73B again, thereby closing the inlet 73B, and the blocking surface 82Bb of the blocking surface portion 82B passes over the outlet 74B to close the outlet 74B again, thereby closing the outlet 74B. In addition, the transport surface portion 85A completely passes over the inlet 73B and is in the process of moving toward the outlet 74B. In addition, the other transport surface portion 85B is in the process of passing over the outlet 74B.

At this time, the space S1 of the transport surface portion 85A moves in the state of facing the inner wall 72*a* of the internal space 72 of the main body portion 71B, and therefore, the toner 17, which is received and accommodated in the space S1, is transported in the state of being held in the space S1 by the movement of the transport surface portion 85A. At this time, when an air gap in which no toner 17 is present exists in the space S1, the toner 17 easily moves in the space S1 when the toner 17 is transported so that the toner 17 is efficiently loosened. In addition, at this time, the space S2 of the other transport surface portion 85B is connected with the inlet 73B in the state of facing the inlet 73B, and as a result, the toner 17 existing in the passageway space 76B of the first connecting portion 75B starts to be received by moving to flow into the space S2.

At this time, after closing the inlet 73B and the outlet 74B of the main body portion 71B, the blocking surface portion 82B blocks between the inlet 73B and the outlet 74B. For this reason, the toner 17 existing in the passageway space 76B of the first connecting portion 75B is not accommodated in the space S1 through the inlet 73B. Therefore, the toner 17, which is transported in the state of being held in the space S1, is not pushed by the subsequent toner 17 which is continuously received from the inlet 73B. That is, the toner 17 at the time of being transported in the state of being held in the space S1 is shut off from the phenomenon that the toner receives a transport force applied by the subsequent toner 17 which is continuously conveyed by receiving a transport force of the transport member 185 from the toner receiving unit 18B.

Finally, at time points (timing) exemplified in FIGS. 15G and 15H, the rotating member SOB is in a state where the transport surface portion 85A is in the process of passing over the outlet 74B, and the transport surface portion 85B is in the process of passing over the inlet 73B. In addition, in this case, (the blocking surfaces 82Bb and 82Ba of) the other blocking surface portion 82B passes over both of the inlet 73B and the outlet 74B, respectively, thereby opening the inlet 73B and the outlet 74B, and blocking between the inlet 73B and the outlet 74B.

At this time, since the space S1 of the transport surface portion 85A is in a state of being connected with the outlet 74B, the toner 17, which is transported in the state of being held in the space S1, is discharged by moving to flow into the passageway space 78B of the second connecting portion 77B through the outlet 74B. In addition, at this time, the space S2 of the transport surface portion 85B is connected with the inlet 73B, and as a result, the toner 17 existing in the passageway space 76B of the first connecting portion 75B is moved and received into the space S2.

Even in this case, since the blocking surface portion 82B is in a state of blocking between the inlet 73B and the outlet 74B of the main body portion 71B, when the toner 17 is discharged to the passageway space 78B of the second connecting portion 77B, the toner 17 in the space S1 is shut off from a phenomenon that the toner 17 receives a transport force applied by the subsequent toner 17 which is continuously conveyed by receiving transport force of the transport member 185 from the toner receiving unit 18B.

In addition, in the rotating member 80B, the toner 17 is also transported by the space 32 of the transport surface portion 85B of the rotating member 803 like the space S1 of the above-mentioned transport surface portion 85A.

In addition, when a part of the toner 17 within the space S1 (S2) of the transport surface portion 85A (85B) of the rotating member 803 remains without being discharged, the toner 17 remaining in the space S1 (S2) is transported by the rotation of the rotating member 80B in the state of being held within the space S1 (S2), and is transported to the outlet 743 again to awaits an opportunity to be discharged.

In the developing system 15C, when the new toner 17 is transported from (the discharge port 184 of) the toner receiving unit 18B to the toner replenishing unit 52 of the developing device 5, the above-described special transport of the toner 17 is repeated as the rotating member 801B rotates in the internal space 72 of the main body portion 71B of the connecting member 70B.

As in the developing systems 15 and 15B according to the first and second exemplary embodiments, even in the developing system 15C, when the toner 17 is discharged from the discharge port 184 of the toner receiving unit 18B, the toner 17 is continuously sent to the connecting member 70B by receiving the transport force of a certain degree by the transport member 185.

However, even in the developing system 15C, since the blocking surface portion 82B of the rotating member 80B rotating in the internal space 72 of the main body portion 71B of the connecting member 70B directly closes the inlet 73B and the outlet 74B of the main body portion 71B or blocks between the inlet 73B and the outlet 74B, the transport force of the toner 17 from the toner receiving unit 18B is temporarily blocked (e.g., the states exemplified in FIGS. 15A to 15H) due to the presence of (the blocking surface portion 82B of) the rotating member 80B.

For this reason, when the toner 17 is transported from the toner receiving unit 18B toward the toner replenishing unit 52 of the developing device 5 via the connecting member 70B, the toner 17 does not continuously receive a transport force applied by the transport member 185 from the toner receiving unit 181B (through the movement of the subsequent toner 17).

As a result, even in the developing system 15C, because the toner 17, which is transported toward the toner replenishing unit 52 of the developing device 5, is not continuously pressed against, particularly, an inner wall, which configures the passageway space 78B of the second connecting portion 77B which is responsible for connection with the toner replenishing unit 52, or an inner wall of the protruding portion 62 of the toner replenishing unit 52, there is no concern that a part of the toner 17 adheres to the respective inner walls and the like. Therefore, the toner 17, which is transported toward the toner replenishing unit 52, is normally replenished into the accommodating portion 51 without a loss caused by the adhesion.

Even in the developing system 15C, because the toner 17, which is transported toward the toner replenishing unit 52 of the developing device 5, is not continuously pressed against the replenishing port 61 which is in a closed state by the developer 16*b* in the toner replenishing unit 52, for example, there is no concern that the toner 17 will unexpectedly pass through the gap 12 of the replenishing port 61. Therefore, there is no concern that the toner 17, which is transported toward the toner replenishing unit 52, unexpectedly passes through the replenishing port 61 to be excessively replenished to the accommodating portion 51 of the developing device 5, and the toner 17 is normally supplied to the accommodating portion 51.

Another Exemplary Embodiment

In the first to third exemplary embodiments, descriptions have been made on the configuration examples, in which, as transport surface portions 85, 85A, and 85B of the rotating members 80 and 80B, transport surfaces, which configure a part of the spaces S, S1, and S2 that accommodate and transport the toner 17, are formed by being cut into a plane. However, in addition to the configuration examples, for example, the transport surface portion 85, (85A and 85B) which is formed as a curved surface (preferably, a curved surface that expands to approach the inner wall 72*a* of the internal space 72), may be employed.

As the rotating member 80, a configuration having three or more transport surface portions 85 may be applied as long as the toner may be smoothly received through the inlet 73, and the toner may be smoothly discharged through the outlet 74.

In the first to third exemplary embodiments, as the developing systems 15, 15B, and 15C, the configuration examples in which the toner receiving units 18 and 18B are disposed at positions which are deviated from the toner replenishing units 52 and 52B of the developing device 5 in the horizontal direction have been described. However, a configuration in which the toner receiving units 18 and 18B, which are disposed at positions (e.g., the disposition position illustrated in FIG. 16) above (including a position obliquely above) the toner replenishing units 52 and 52B of the developing device 5, may also be applied as the developing systems 15 (15B, and 15C) as long as, for example, the special transport of the toner 17 is effective by the rotation of the rotating members 80 and 80B in the internal space 72 in the main body portions 71 and 71B of the connecting members 70 and 70B. In this case, particularly, when the toner receiving units 18 and 18B having a comparatively high transport force are applied as the transport member 185, the special transport of the toner 17 by the rotation of the rotating members 80 and 80B exhibits an effect.

In the first to third exemplary embodiments, as the toner replenishing units 52 and 52B of the developing device 5, the configuration examples in which the replenishing port 61 and the rotating body 65 are combined have been described. However, the present invention is not particularly limited to this configuration example. In addition, for example, a configuration, which additionally includes an opening and closing shutter that moves from the lower side to open and close the replenishing port 61 based on whether or not the developer is transported by the rotating body 65, may be applied to the toner replenishing units 52 (and 52B), as long as, for example, the replenishing port 61 may be opened and closed based on the consumption state of the toner 17 in the developer within the accommodating portion 51.

In the first to third exemplary embodiments, the image forming apparatus 1 that uses one developing system 15 (15B, and 15C) has been exemplified. However, an image for apparatus of a type that uses plural developing systems 15 (15B and 15C) may be applied as the image forming apparatus 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing system comprising:

a developing device that includes a replenishing unit configured to replenish toner into an accommodating portion of a developer including toner and a carrier, via a replenishing port;

a receiving unit that includes a transport member configured to transport received toner to a discharge port;

a connecting member that has an internal space configured to be formed with an inlet connected with the discharge port and an outlet connected with the replenishing port; and a rotating member configured to be rotated in the internal space, wherein the rotating member includes:

a blocking surface portion configured to close the inlet and the outlet while passing over the inlet and the outlet; and a transport surface portion configured to receive or discharge the toner while passing over the inlet and the outlet, wherein the replenishing unit is rotatably provided at a portion between the replenishing port and the accommodating portion in a state where an outer circumferential surface of the replenishing unit faces the replenishing port with interposing a gap, wherein the replenishing unit has a magnetic force generating region configured to generate a magnetic force above an upper surface of the developer in the accommodating portion, and wherein the replenishing unit includes a rotating body configured to transport the developer in the accommodating portion with holding the developer on the outer circumferential surface by the magnetic force of the magnetic force generating region when the upper surface of the developer exceeds a predetermined reference height, and to close a gap with the replenishing port by the held developer.

2. The developing system according to claim 1, wherein the rotating member has a timing at which the blocking surface portion simultaneously closes the inlet and the outlet.

3. The developing system according to claim 1, wherein the receiving unit is provided at a position deviated from the replenishing unit of the developing device in a horizontal direction.

4. The developing system according to claim 2, wherein the receiving unit is provided at a position deviated from the replenishing unit of the developing device in a horizontal direction.

5. An image forming apparatus comprising:

an image carrier on which an electrostatic latent image is formed; and the developing system according to claim 1 configured to develop the electrostatic latent image on the image carrier.

6. An image forming apparatus comprising:

an image carrier on which an electrostatic latent image is formed; and the developing system according to claim 2 configured to develop the electrostatic latent image on the image carrier.

7. An image forming apparatus comprising:

an image carrier on which an electrostatic latent image is formed; and the developing system according to claim 3 configured to develop the electrostatic latent image on the image carrier.

8. An image forming apparatus comprising:

an image carrier on which an electrostatic latent image is formed; and the developing system according to claim 4 configured to develop the electrostatic latent image on the image carrier.

* * * * *